US007334620B2

(12) United States Patent
Imazeki

(10) Patent No.: US 7,334,620 B2
(45) Date of Patent: Feb. 26, 2008

(54) ADHESIVE TAPE CUTTER

(75) Inventor: Toshiaki Imazeki, Chiba-ken (JP)

(73) Assignee: CPC Co., Ltd., Chiba-ken (JP)

( * ) Notice: Subject to any disclaimer, the term of this patent is extended or adjusted under 35 U.S.C. 154(b) by 448 days.

(21) Appl. No.: 11/007,241

(22) Filed: Dec. 9, 2004

(65) Prior Publication Data

US 2006/0118245 A1 Jun. 8, 2006

(30) Foreign Application Priority Data

Dec. 3, 2004 (JP) ..... 2004-351772

(51) Int. Cl.
*B31F 1/08* (2006.01)
*B65H 35/07* (2006.01)

(52) U.S. Cl. ..... 156/463; 156/227; 156/465; 156/526; 156/577; 493/455

(58) Field of Classification Search ..... 156/227, 156/461, 463, 465, 526, 574, 577; 493/438, 493/439, 455
See application file for complete search history.

(56) References Cited

U.S. PATENT DOCUMENTS

| | | | | |
|---|---|---|---|---|
| 2,309,093 | A * | 1/1943 | Borden | 493/328 |
| 4,576,674 | A * | 3/1986 | Le Tarte | 156/463 |
| 6,945,297 | B1 * | 9/2005 | Gonzalez et al. | 156/463 |
| 2001/0000096 | A1 * | 4/2001 | Tolerico et al. | 156/200 |
| 2004/0238109 | A1 * | 12/2004 | Gonzalez | 156/227 |
| 2006/0175017 | A1 * | 8/2006 | Namekawa et al. | 156/443 |

FOREIGN PATENT DOCUMENTS

| | | | |
|---|---|---|---|
| DE | 4208896 | A1 * | 9/1993 |
| GB | 2361910 | A * | 11/2001 |
| JP | 2001-146356 | | 5/2001 |
| WO | WO8304380 | A1 * | 12/1983 |

OTHER PUBLICATIONS

Marson Corporation, Edge Blender Tape Dispenser System, 1987.*
English Language Abstract of JP 2001-146356.
U.S. Appl. No. 10/999,149 to Imazeki, filed Nov. 30, 2004.
U.S. Appl. No. 11/029,344 to Imazeki, filed Jan. 6, 2005.

* cited by examiner

*Primary Examiner*—Mark A. Osele
(74) *Attorney, Agent, or Firm*—Greenblum & Bernstein, P.L.C.

(57) ABSTRACT

The present invention provides an adhesive tape cutter capable of, when attaching an adhesive tape to an object, automatically forming a non-adhesive area that constitutes a tab in order to make it easier to peel off the adhesive tape. An adhesive tape cutter 1 comprises: a support member 5 located at one end of a main bracket 2 to support a wound body of adhesive tape 4 so that the wound body of adhesive tape 4 can rotate; a cutting member 6 located at the other end of the main bracket 2 to cut an adhesive tape 3 drawn from the wound body of adhesive tape 4; an overlapping-area-forming mechanism 7 located between the support member 5 and the cutting member 6 to form an overlapping area 3E along one margin of the adhesive tape 3 in its lengthwise direction; and a pressing member 8 that is located near the cutting member 6 and comes into contact with the non-adhesive surface 3B of the adhesive tape 3, thereby pressing the adhesive tape 3 to the object.

19 Claims, 20 Drawing Sheets

ADHESIVE TAPE CUTTER

BACKGROUND

The present invention relates to a tape cutter for a wound body of wide adhesive tape used frequently for packaging or other purposes. More particularly, this invention relates to a hand-sized tape cutter that forms a non-adhesive area of the adhesive tape, which has been drawn from the wound body of adhesive tape, by folding under the side edge of the adhesive tape along its lengthwise direction to cause the adhesive surfaces of the tape to stick together, thereby making it easier to peel off the adhesive tape when it is attached to an object.

Adhesive tape is made by applying an adhesive agent containing rubber or synthetic resin as its principal component, onto one side of a long thin-film base material of, for example, cloth, cellophane, kraft paper, rubber, or polyvinyl chloride. This adhesive tape is generally wound into a roll and is distributed as a wound body of adhesive tape and is used for various adhesion purposes. Wide adhesive tape with a tape width of about 50 mm is frequently used particularly for packaging such as sealing cardboard boxes.

When such wide adhesive tape is used for packaging or other purposes, the adhesive tape is drawn from the wound body of adhesive tape, is cut to a desired length, and then attached to an object. As an example of a tape cutter that makes it easier to perform the above operation, there is a tape cutter that enables attachment of the adhesive tape merely by holding it in a hand and pressing the adhesive surface of the adhesive tape pulled out at the top end of the tape cutter against an object.

With this type of tape cutter, the adhesive tape drawn from the wound body of adhesive tape is flat, so it bends and hangs when it is pulled out of the wound body, and it then can become stuck to the outside surface of the wound body of adhesive tape. Accordingly, when attaching the adhesive tape, a user has to go through the inefficient process of peeling off and holding the edge of the tape with the fingertips, and then unwinding and attaching the adhesive tape to the object.

Lately, arms for supporting the unwound tape are used and placed on both side ends of the tape cutter in the area for guiding the tape in order to prevent the tape from becoming stuck to the outside surface of the wound body of adhesive tape. However, since the drawn tape is flat, when a long length of the tape is pulled out beyond the supporting arms, it bends and hangs, and sometimes becomes stuck to other objects, and then the tape cutter is no longer operable. Therefore, the supporting arms need to be located at positions close to the top end of the unwound tape, that is, close to the tape cutting blade. However, if a user holds the tape cutter in his/her hand and tries to press and attach the adhesive surface of the unwound top end of the adhesive tape to an object, the supporting arms are in the way and the tape cannot be attached properly. As a result, the fact is that the user has no choice but to employ the inefficient conventional method of holding the tape with the fingertips, pulling out, and then attaching the top end of the tape.

In most cases, the tape cutting blade attached to the tape cutter is exposed and, therefore, may be dangerous. There is another type of tape cutter having a cover plate that is located above the tape cutting blade and capable of swinging via a spring. However, even when the tape cutter is not in use, the cover plate will move if a finger or anything else touches it. Therefore, this type of tape cutter cannot assure complete safety.

As an improvement on the above-described type of tape cutter, a tape cutter having the following structure is proposed: a tape guiding member along which a pulled-out adhesive tape is guided is formed at one end of a main body on which the adhesive tape, which is wound in a roll, is mounted; a tape cutting blade is placed at the top end of the tape guiding member; a plane along which the pulled-out adhesive tape is guided is formed in such a manner that its middle part is raised compared to its edges; a tape holding member that has a plurality of protrusions on its surface is placed in such a manner that it covers and overhangs the plane along which the adhesive tape is guided; connecting arms are formed at both side ends of the tape holding member to cover an area extending from the top end of the tape cutting blade to the plane along which the adhesive tape is guided; the cover plate having a plurality of protrusions on its surface is held between and is made to engage with the connecting arms at both side ends of the tape holding member, and is attached to the tape holding member via a main shaft that passes through the connecting arms and is fixed to the side faces of the tape holding member (see, for example, Japanese Patent Laid-Open (Kokai) No. 2001-146356).

In most cases, wide adhesive tape for packaging is often used for the purpose of temporary binding. Having been attached to an object, the adhesive tape is later either torn or cut off.

The adhesive tape is made by applying an adhesive agent over one side of a base material. Since this base material is thin and the adhesive agent is applied to the entire one side of the base material, it is difficult and cumbersome to peel off the adhesive tape attached to an object. Specifically speaking, in order to peel off the adhesive tape where the entire adhesive surface is stuck to the object, it is necessary to form a tab by, for example, scratching the adhesive tape with finger nails or the like to cause the end of the adhesive tape to stick up, and to then pull the tab to peel off the adhesive tape. This process of scratching and forming a tab is very cumbersome and annoying.

SUMMARY

The present invention aims to improve the conventional adhesive tape cutters described above. It is the object of this invention to provide an adhesive tape cutter that can, when attaching adhesive tape to the object, automatically form a non-adhesive area that will constitute a tab for making it easier to later peel off the adhesive tape attached the object.

In order to achieve the above-described object, this invention provides an adhesive tape cutter for attaching, to an object, adhesive tape drawn from a wound body of adhesive tape made by winding the tape, one side of which is an adhesive surface, in a roll; the adhesive tape cutter comprising: a support member located at one end of a main bracket to support the wound body of adhesive tape in such a manner that the wound body of adhesive tape can rotate; a cutting member located at the other end of the main bracket to cut the adhesive tape drawn from the wound body of adhesive tape supported by the support member; an overlapping-area-forming mechanism located between the support member and the cutting member to form an overlapping area of the adhesive tape, along at least one margin in its lengthwise direction, said overlapping area made by folding a margin of a specified width of the adhesive tape under toward the adhesive surface side; and a pressing member located downstream of the cutting member to press the non-adhesive surface of the adhesive tape that is cut by the cutting member and then attached to the object; wherein the overlapping-area-forming mechanism comprises: a fold-starting member that is located near an adhesive tape unwinding position of the wound body of adhesive tape, supports the non-adhesive surface of the adhesive tape, supports the adhesive surface of the adhesive tape except for a specified folding width along the margin of the adhesive tape, and folds the folding width area; a main folding member that is located downstream of the fold-starting member and folds under, at an acute angle, the area of the adhesive tape folded by the fold-starting member; and an attaching member that is located downstream of the main folding member, supports the non-adhesive surface of the adhesive tape, and presses and attaches the area folded under by the main folding member to the adhesive surface of the adhesive tape.

In the adhesive tape cutter having the above-described structure, the fold-starting member supports (or is in contact with) the adhesive surface of the adhesive tape when the overlapping area is formed on the adhesive tape drawn from the wound body of adhesive tape supported by the tape-support member in a rotatable manner. Since this adhesive tape cutter has no member (such as a roller) for pressing the adhesive tape hard against the fold-starting member, at a position on the other side of the adhesive tape opposite the fold-starting member, the adhesive tape is guided downstream without having the adhesive surface of the adhesive tape stuck fast to the surface of the fold-starting member. Moreover, the non-adhesive surface of the adhesive tape is in contact with the support member and the attaching member. Accordingly, little power is required in order to draw the adhesive tape from the wound body of adhesive tape, thereby making it possible to unwind the adhesive tape smoothly.

Since the tape cutter comprises the pressing member for pressing the non-adhesive surface of the adhesive tape cut by the cutting member and attached to the object, it is possible for a user to attach the adhesive tape to the object with certainty, without taking the trouble to use his/her hand to press the adhesive tape to the object after attaching the adhesive tape to the object. The adhesive tape does not bend inadvertently and it is thereby possible to attach the adhesive tape to the object more smoothly and easily.

The adhesive tape cutter of this invention can further comprise a pressing roll located between the cutting member and the overlapping-area-forming mechanism, that presses the adhesive tape with the overlapping area to the object. In addition to the above-described advantageous effects, this structure makes it possible to attach the adhesive tape to the object with more certainty.

Moreover, the pressing member can have an adhesive-tape-positioning member for positioning the adhesive tape near the cutting member after the adhesive tape is cut by the cutting member. Because of the existence of this adhesive-tape-positioning member, it is possible to further ensure that the adhesive tape does not bend inadvertently, and it is thereby possible to attach the adhesive tape to the object smoothly.

Furthermore, the adhesive tape cutter of this invention can further comprise a tape cover that is attached to and is rotatable on the main bracket, covers at least part of the wound body of adhesive tape supported by the support member, and comes into contact with the outside surface of the wound body of adhesive tape, thereby forming a grippable part.

This adhesive tape cutter can be structured in the following manner: a protruding part that protrudes from the tape cover toward the support member and can come into contact with the inside surface of the wound body of adhesive tape is formed at at least one side of the wound body of adhesive tape in its widthwise direction opposite the side where the overlapping area is formed. As the protruding part is formed on the tape cover, when a user holds the tape cover and pulls out the adhesive tape from the wound body of adhesive tape, the protruding part controls the position of the wound body of adhesive tape, thereby making it possible to form the overlapping area with more certainty.

Moreover, in the adhesive tape cutter of this invention, the tape cover can have a convex part located on the inside surface of the tape cover opposite the wound body of adhesive tape, that can come into contact with the wound body of adhesive tape. When a user holds the tape cover and pulls out the adhesive tape from the wound body of adhesive tape, the existence of the convex part makes it possible to prevent, with more certainty, the tape cover from holding down the wound body of adhesive tape. Therefore, it is possible to pull out the adhesive tape more easily.

Furthermore, the adhesive tape cutter of this invention can further comprise a supporting roll located between the overlapping-area-forming mechanism and the pressing roll, that supports and guides the adhesive tape to the pressing roll.

It is also possible to form protrusions and indentations on the surface of the supporting roll. This structure makes it possible to reduce the surface area of the fold-starting member (the contact area) that comes into contact with the adhesive surface of the adhesive tape. Accordingly, much less power is required to draw the adhesive tape from the wound body of adhesive tape, thereby making it possible to unwind the adhesive tape more smoothly.

Moreover, in the adhesive tape cutter of this invention, an area extending from the cutting member to the top end of the tape cover along its outside surface closer to the support member can have a curved shape. This curved shape realizes a structure that enables easy operation when a user holds the tape cutter and attaches the adhesive tape to the object.

The adhesive tape cutter of this invention can further comprise a holding part fixed at a lower part of the main bracket where the overlapping-area-forming mechanism is located. This structure enables a user to hold the holding part and attach the adhesive tape to the object easily.

The adhesive tape cutter having the holding part can further comprise a guiding piece located near the pressing roll and opposite the adhesive surface of the adhesive tape, that guides the adhesive tape with the overlapping area downstream. The existence of this guiding piece makes it possible to prevent, with more certainty, the adhesive tape from bending or twisting inadvertently when attaching the adhesive tape to the object.

Moreover, the pressing member can be composed of a pressing plate that is located downstream of the attaching member and opposite the guiding piece, slopes toward the extended direction of the holding part, and supports and presses the entire non-adhesive surface of the adhesive tape with the overlapping area.

The adhesive tape cutter of this invention can further comprise another support member that is located upstream of the fold-starting member and supports the non-adhesive surface of the adhesive tape.

Furthermore, the adhesive tape cutter of this invention can further comprise, at a position downstream of the cutting member, an adhesive-tape-positioning member for positioning the adhesive tape near the cutting member after the adhesive tape is cut by the cutting member. In addition to the above-described advantageous effects, this structure enables positioning of the adhesive tape, which has been cut by the cutting member, near the cutting member and, therefore, it is possible to prevent the occurrence of trouble, for example, to prevent the adhesive tape from becoming stuck to other objects and making the tape cutter no longer operable.

Regarding the adhesive tape cutter of this invention, it is also possible to form protrusions and indentations on the surface of the fold-starting member. This structure makes it possible to reduce the surface area of the fold-starting member (the contact area) that comes into contact with the adhesive surface of the adhesive tape. Accordingly, much less power is required to draw the adhesive tape from the wound body of adhesive tape, thereby making it possible to unwind the adhesive tape more smoothly.

Moreover, regarding the adhesive tape cutter of this invention, the fold-starting member and the attaching member can be composed of, for example, roller members located in a rotatable manner so that they guide the adhesive tape from upstream to downstream.

Furthermore, a controlling member for controlling the position of the adhesive tape can be placed at the end of the fold-starting member on the side opposite the margin where the overlapping area of the adhesive tape is formed. The existence of this controlling member makes it possible to fold the adhesive tape more stably and with certainty.

It is also possible to structure the adhesive tape cutter of this invention in the following manner: the distance between the controlling member of the fold-starting member and the part of the main folding member that comes into contact with the margin side of the overlapping area of the adhesive tape being shorter than the width of the adhesive tape that forms the wound body of adhesive tape. This structure makes it possible to fold the adhesive tape more stably and with certainty.

Moreover, the main folding member can have a pressing member capable of pressing only part of the adhesive tape, including the area folded by the fold-starting member. Because of this main folding member structure, it is possible to reduce the area of the main folding member that comes into contact with the adhesive surface of the adhesive tape. Accordingly, much less power is required to draw the adhesive tape from the wound body of adhesive tape, thereby making it possible to unwind the adhesive tape more smoothly.

Furthermore, the main folding member can comprises: a first folding guide member that comes into contact with the non-adhesive surface of the adhesive tape folded by the fold-starting member and guides the adhesive tape so that the fold angle of the adhesive tape becomes more acute; and a second folding guide member for guiding the adhesive tape and folding the adhesive tape completely onto itself. Because of this main folding member structure, it is possible to fold the adhesive tape under more stably and with certainty.

This invention also provides an adhesive tape for the adhesive tape cutter described above, wherein a marked line is formed along the overlapping area in the vicinity of the area to become the overlapping area formed by the overlapping-area-forming mechanism of the adhesive tape cutter.

With the adhesive tape having the above-described structure, for the adhesive binding tape cutter, it is possible to use the marked line to indicate the position of the overlapping area when binding the object. Accordingly, when a user intends to remove the binding of the object, he/she can easily look at the tab (i.e. the overlapping area) to peel off the adhesive tape and can thereby remove the binding more easily.

Moreover, the marked line can include at least one of: marks, letters, or pictures to indicate the existence of the overlapping area.

DETAILED DESCRIPTION

Preferred embodiments of the adhesive tape cutter of this invention are described below with reference to the attached drawings.

EMBODIMENT 1

Figure 1:
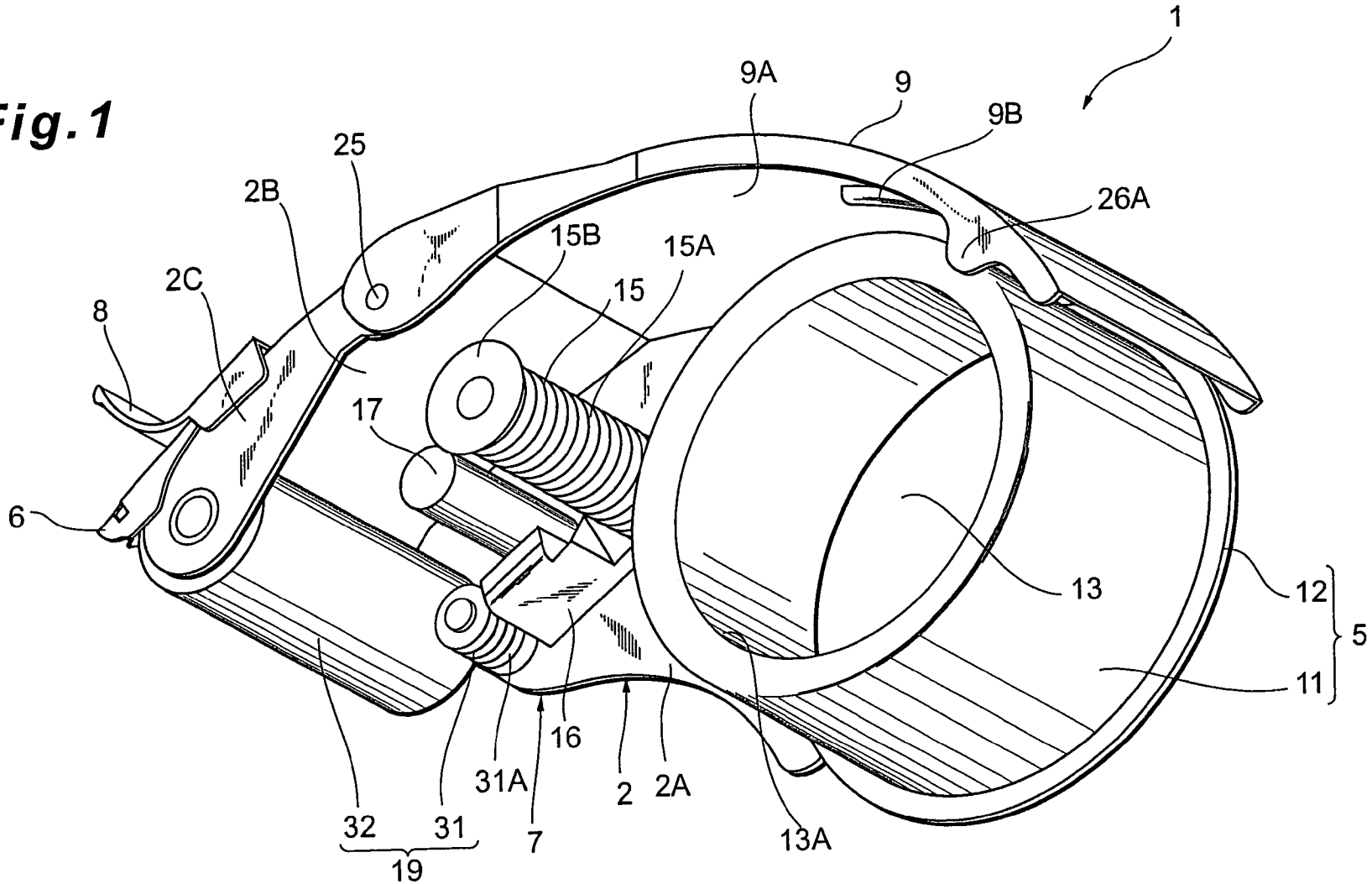
FIG. 1 is a perspective view of an adhesive tape cutter according to Embodiment 1 of this invention.
Figure 2:
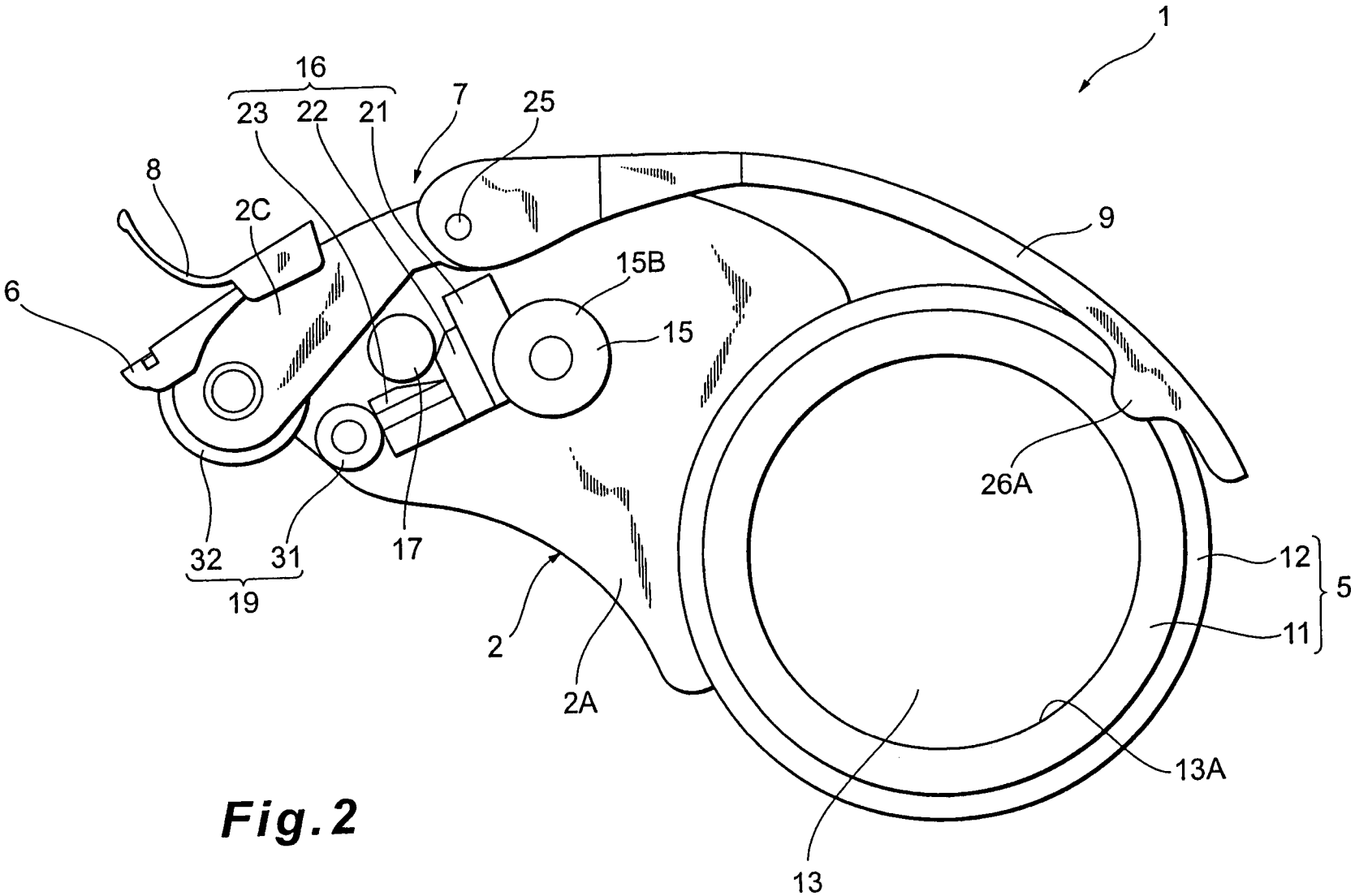
FIG. 2 is a front view of the adhesive tape cutter in FIG. 1.
Figure 3:
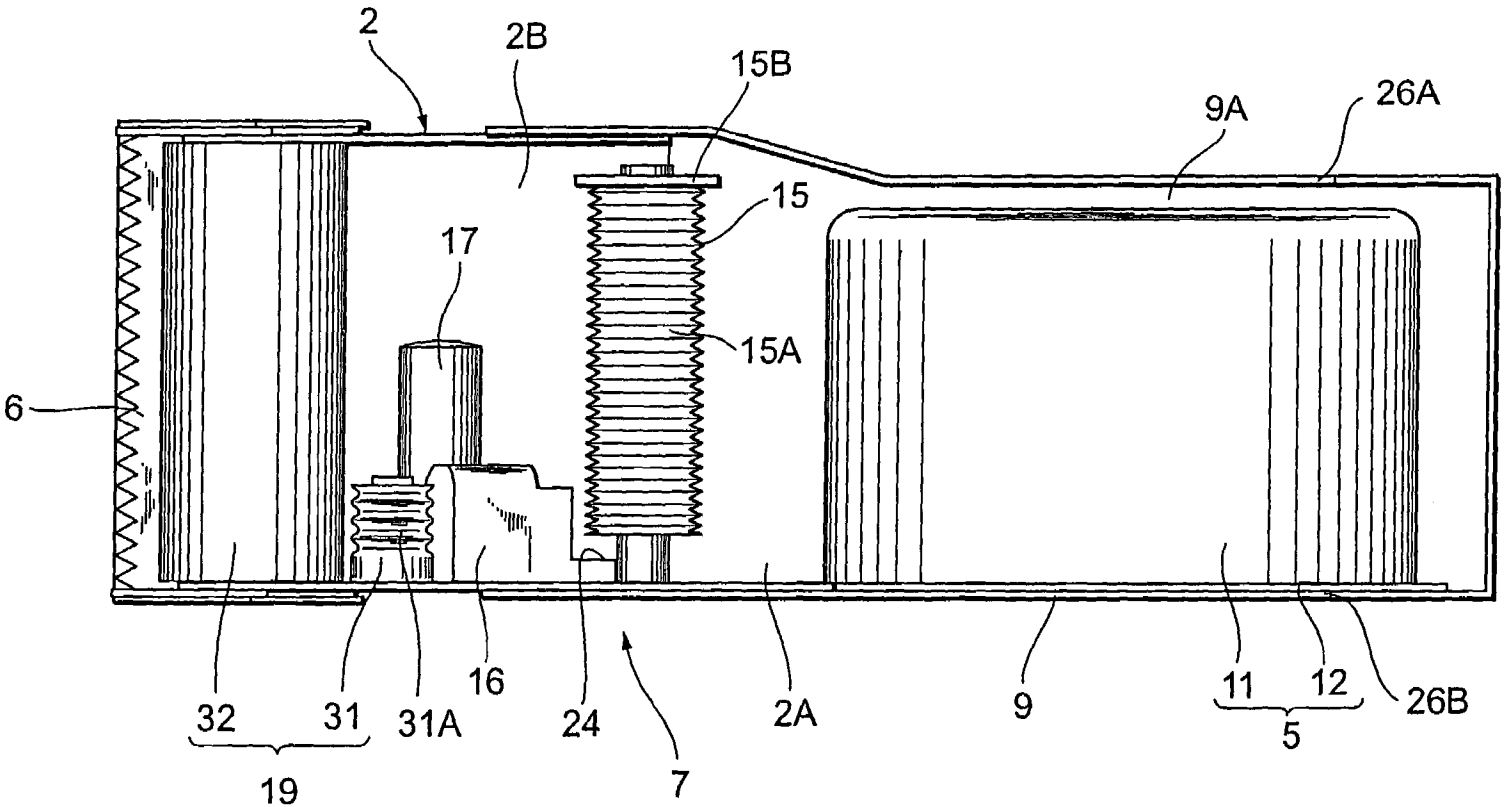
FIG. 3 is a bottom view of the adhesive tape cutter in FIG. 2.
Figure 4:
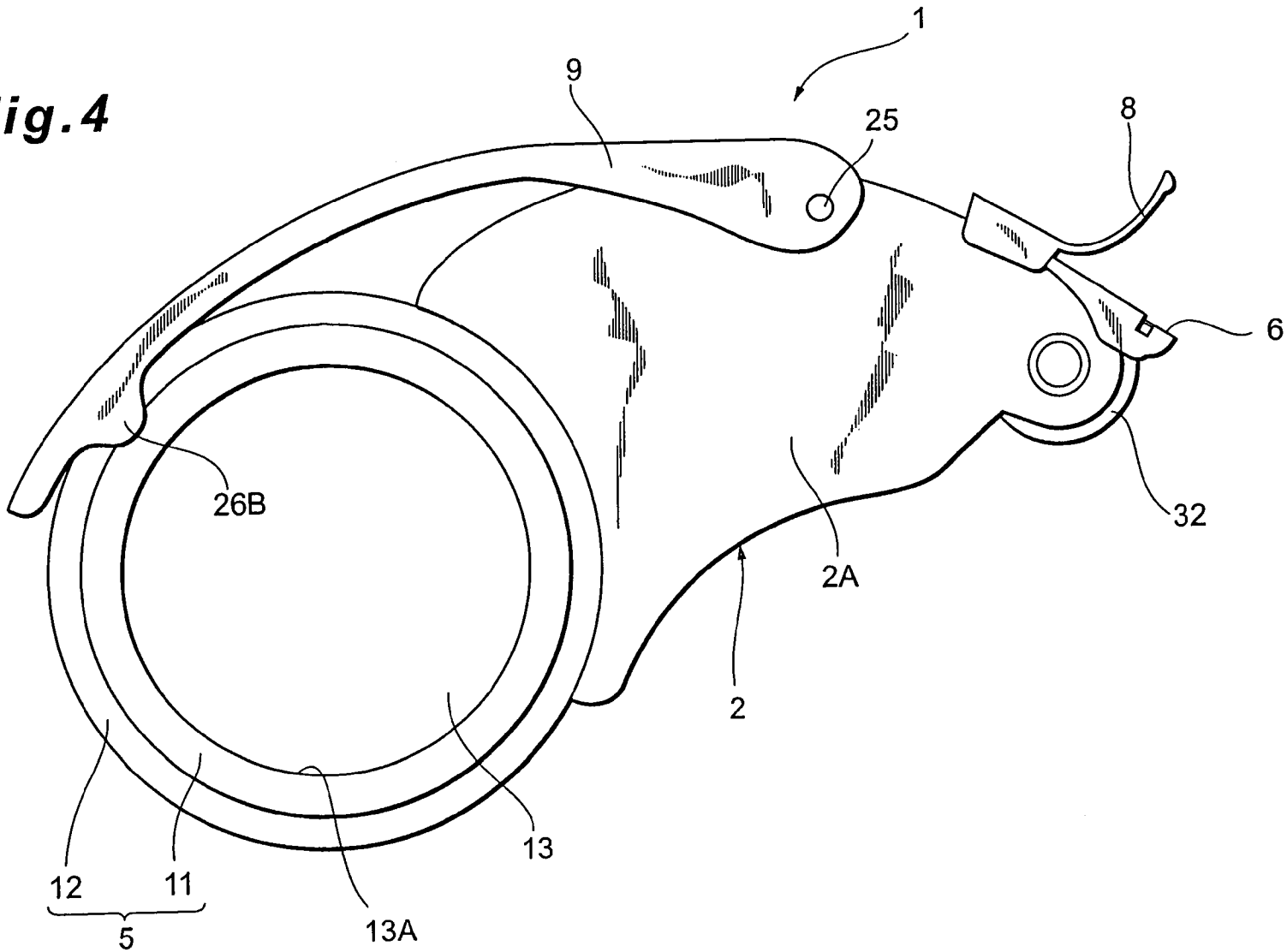
FIG. 4 is a rear view of the adhesive tape cutter in FIG. 2.
Figure 5:
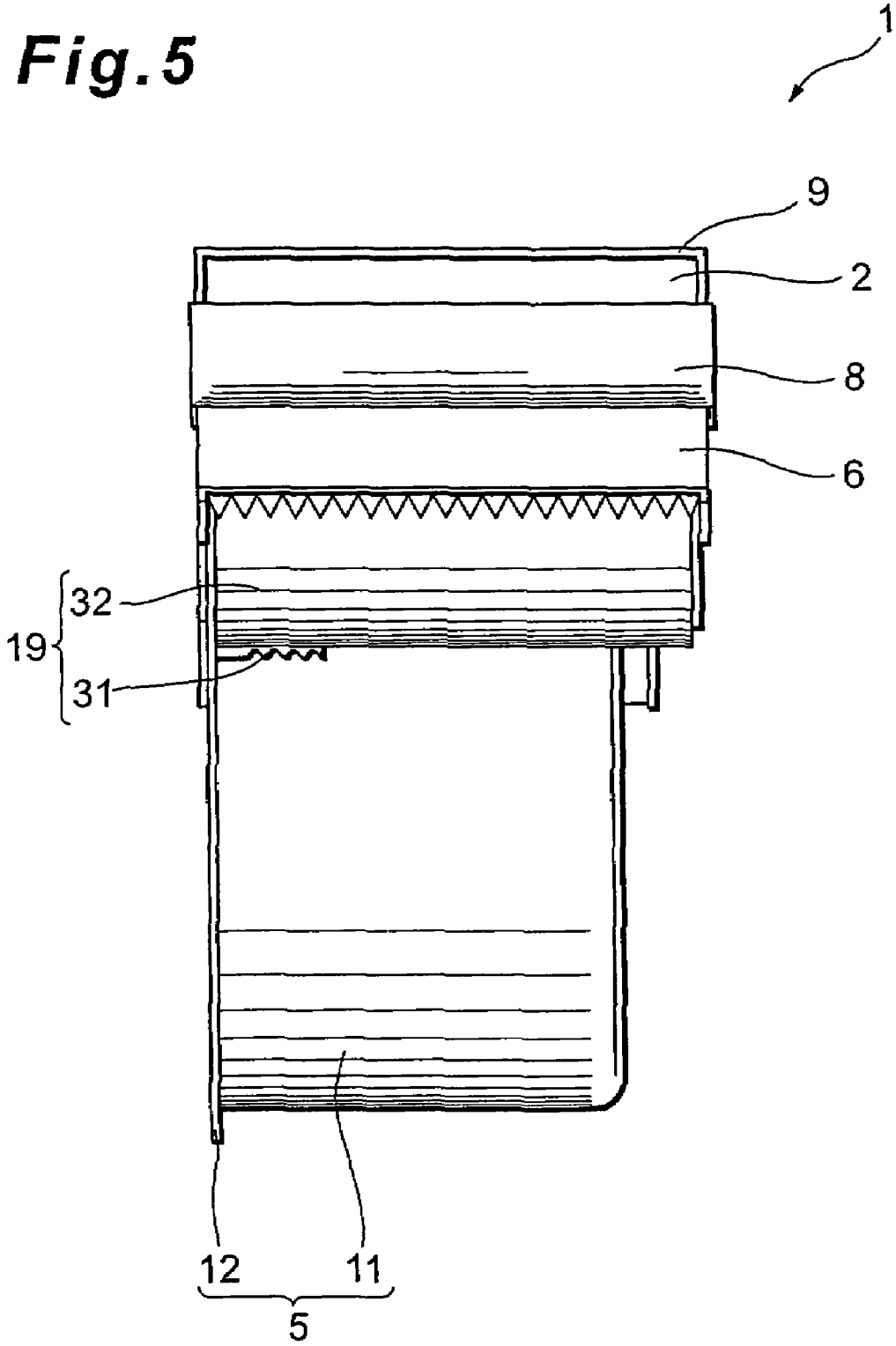
FIG. 5 is a left side view of the adhesive tape cutter in FIG. 2.
Figure 6:
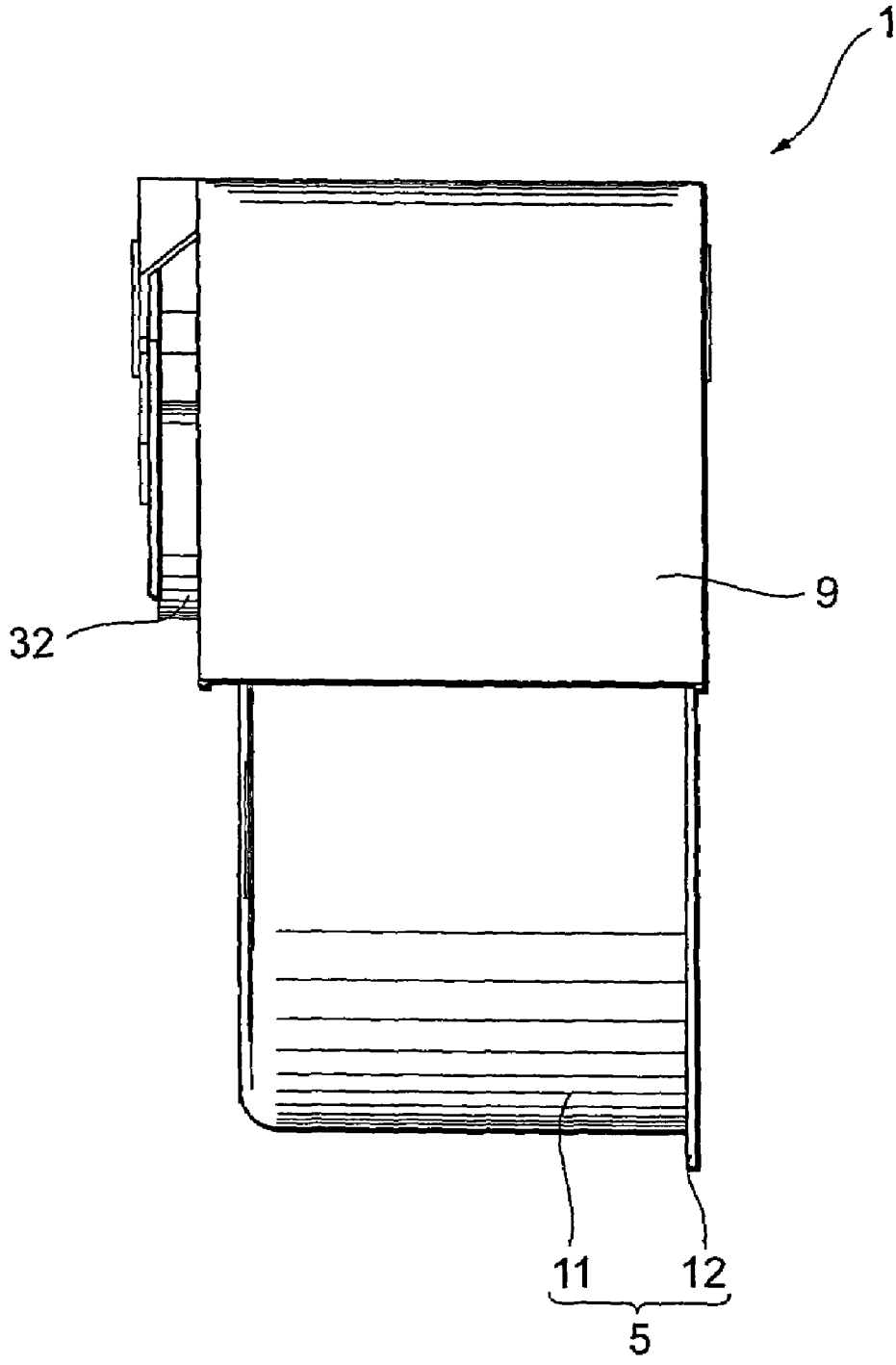
FIG. 6 is a right side view of the adhesive tape cutter in FIG. 2.

FIG. 1 is a perspective view of an adhesive tape cutter according to Embodiment 1 of this invention. FIG. 2 is a front view of the adhesive tape cutter in FIG. 1. FIG. 3 is a bottom view of the adhesive tape cutter in FIG. 2. FIG. 4 is a rear view of the adhesive tape cutter in FIG. 2. FIG. 5 is a left side view of the adhesive tape cutter in FIG. 2. FIG. 6 is a right side view of the adhesive tape cutter in FIG. 2.

Figure 7:
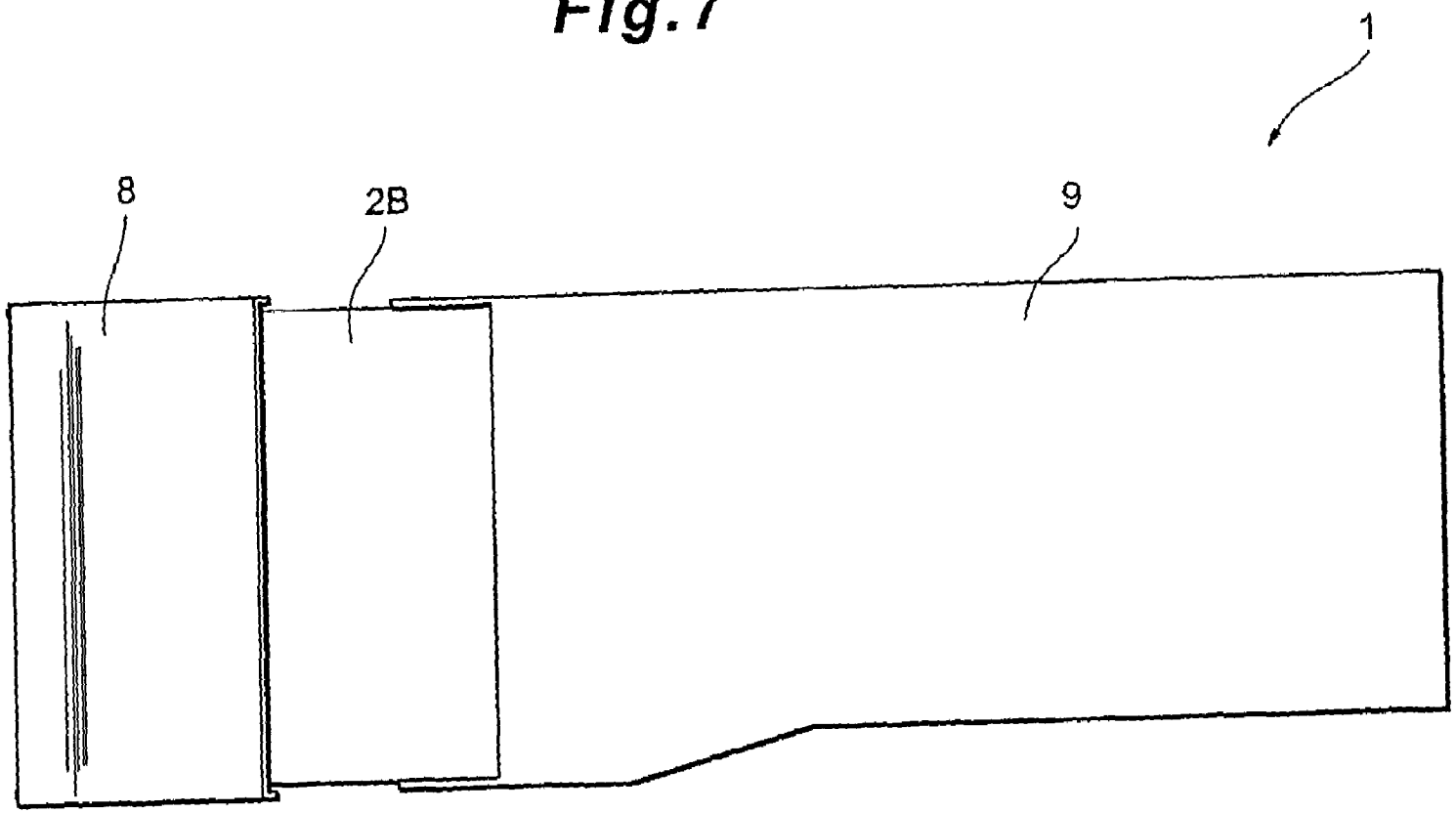
FIG. 7 is a top view of the adhesive tape cutter in FIG. 2.
Figure 8:
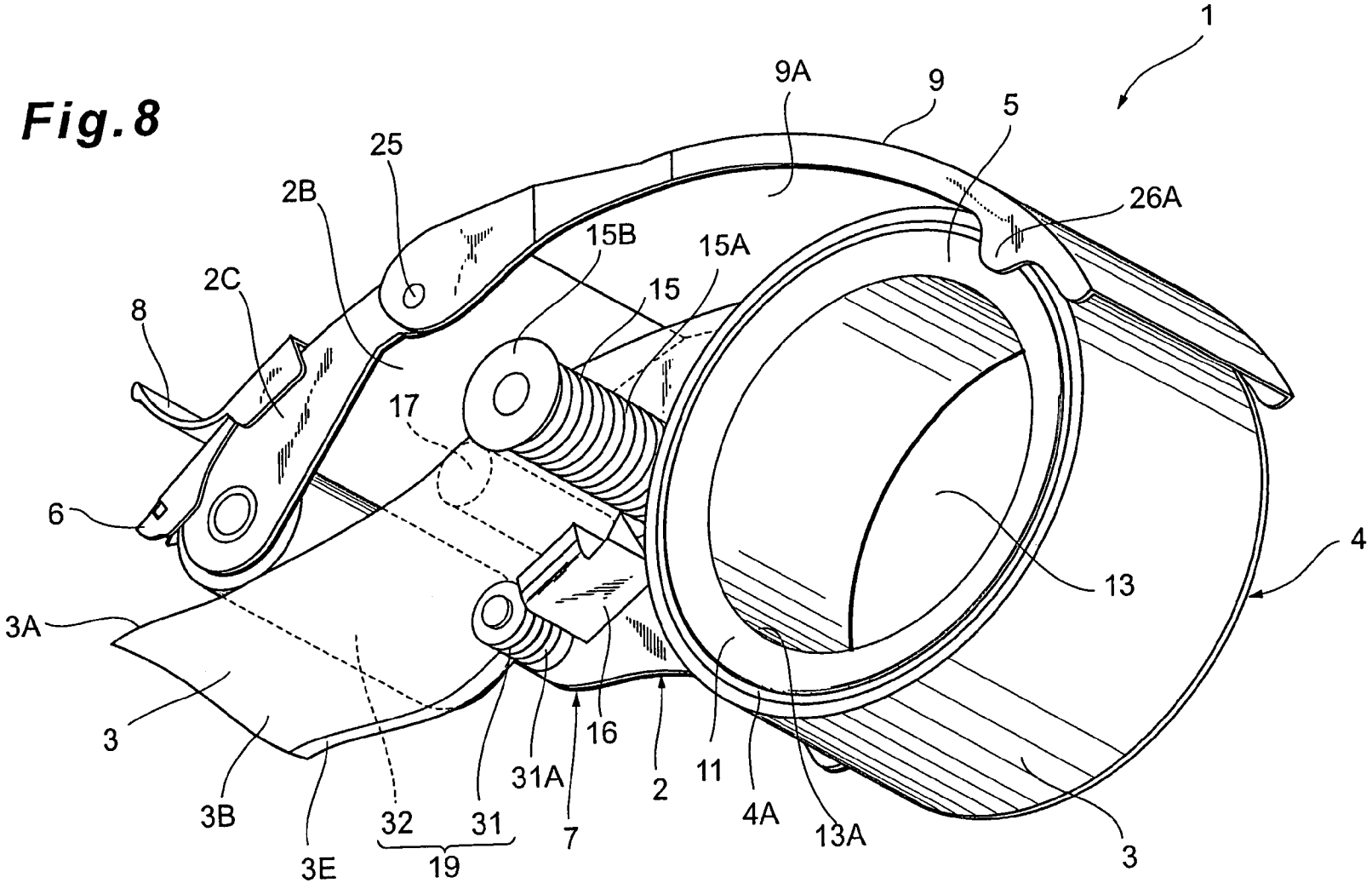
FIG. 8 shows the state in which the wound body of adhesive tape is mounted on the adhesive tape cutter in FIG. 1.
Figure 9:
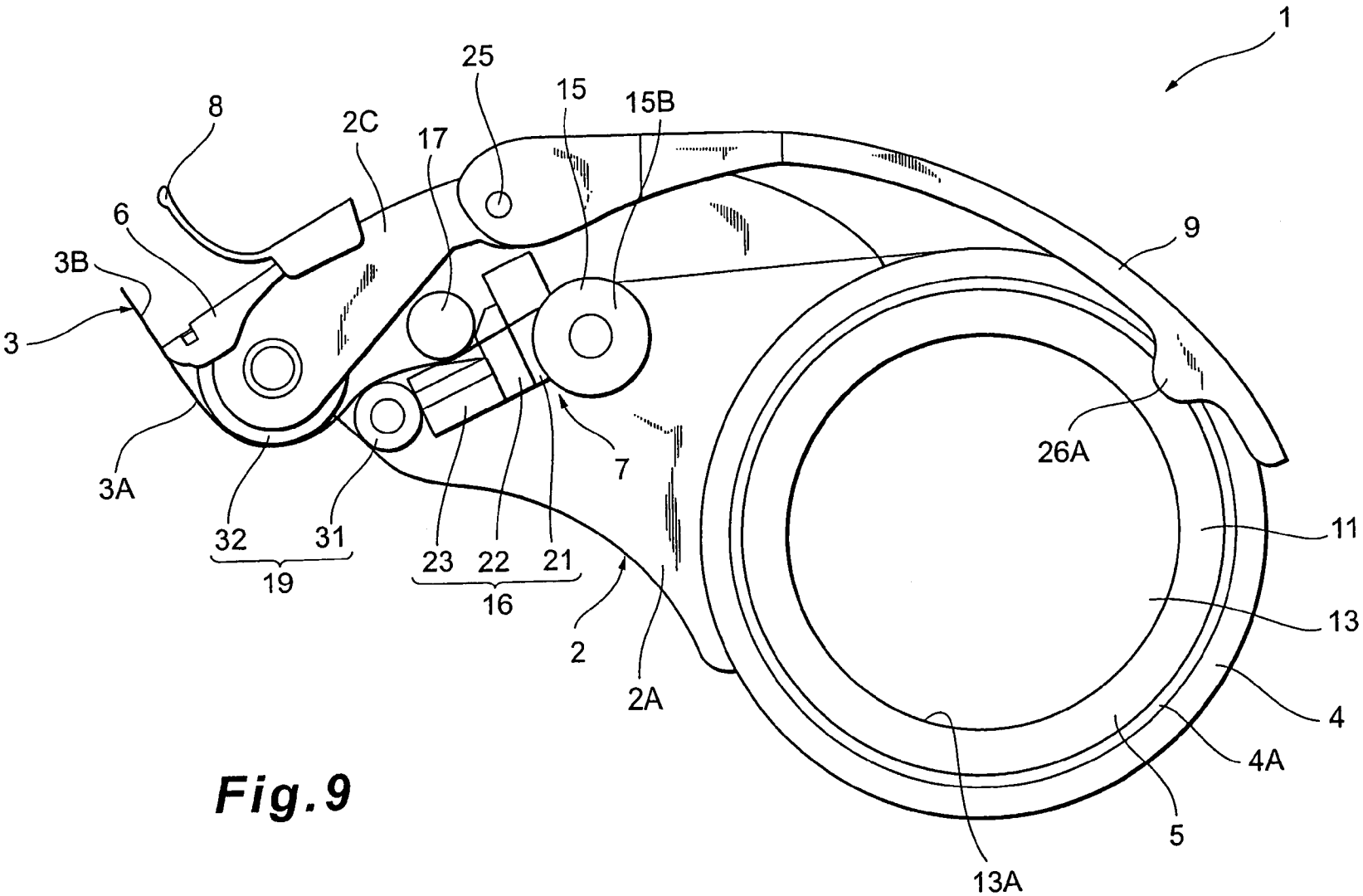
FIG. 9 shows the state in which the wound body of adhesive tape is mounted on the adhesive tape cutter in FIG. 2.
Figure 10:
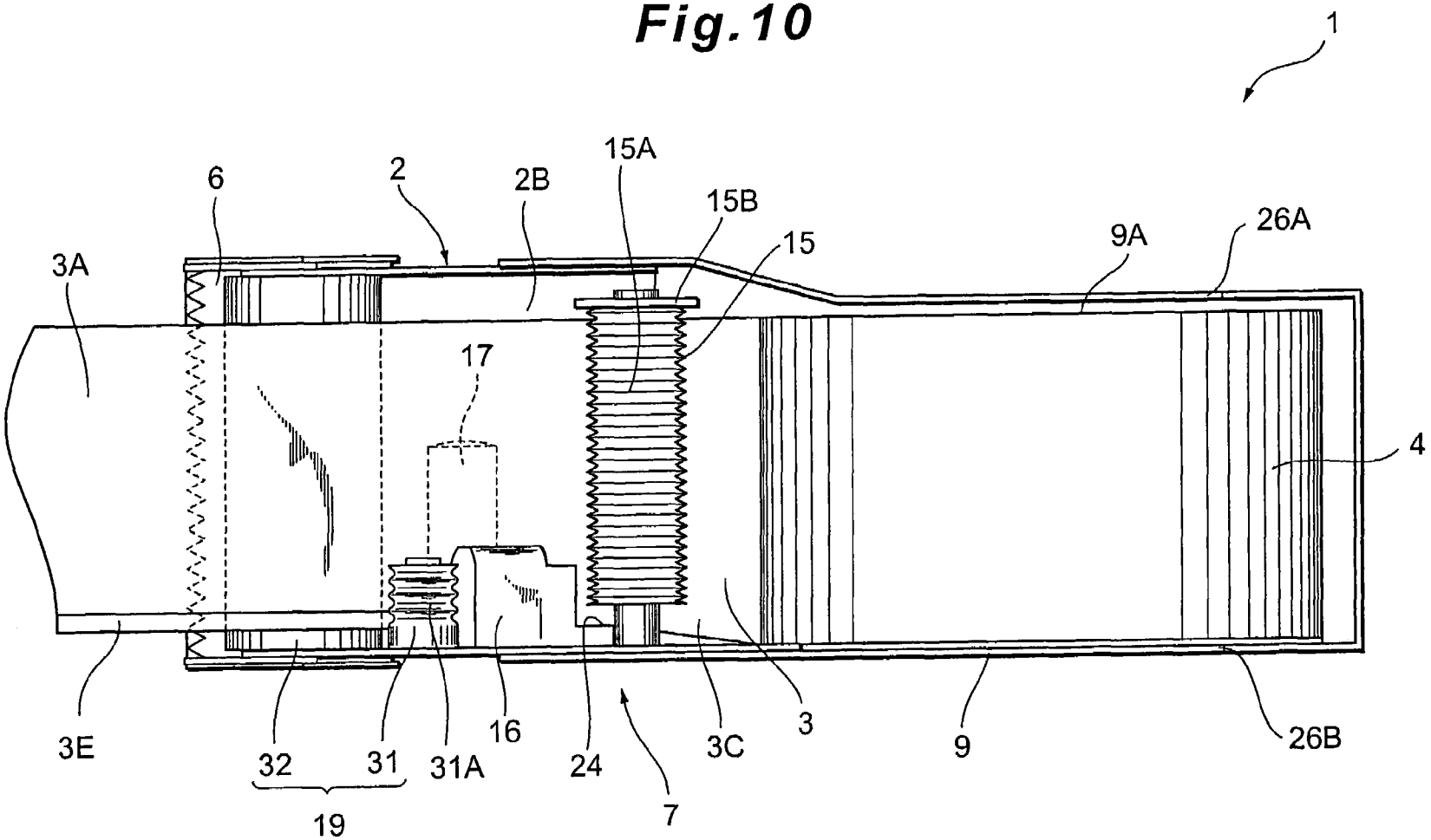
FIG. 10 shows the state in which the wound body of adhesive tape is mounted on the adhesive tape cutter in FIG. 3.

FIG. 7 is a top view of the adhesive tape cutter in FIG. 2. FIG. 8 shows the state in which the wound body of adhesive tape is mounted on the adhesive tape cutter in FIG. 1. FIG. 9 shows the state in which the wound body of adhesive tape is mounted on the adhesive tape cutter in FIG. 2. FIG. 10 shows the state in which the wound body of adhesive tape is mounted on the adhesive tape cutter in FIG. 3.

As shown in FIGS. 1 to 10, an adhesive tape cutter 1 according to Embodiment 1 of this invention comprises: a main bracket 2; a support member 5 that is located at one end of the main bracket 2 and supports a wound body of adhesive tape 4 that is made by winding an adhesive tape 3, one side of which is an adhesive surface 3A, in a roll in such a manner that the wound body of adhesive tape 4 can rotate; a cutting member 6 that is located at the other end of the main bracket 2 and cuts the adhesive tape 3 drawn from the wound body of adhesive tape 4 supported by the support member 5; an overlapping-area-forming mechanism 7 that is located between the support member 5 and the cutting member 6 on the main bracket 2 and forms an overlapping area 3E of the adhesive tape 3, along at least one margin in its lengthwise direction, that is made by folding the margin 3C of the adhesive tape 3 in a specified width in toward the adhesive surface 3A side; a pressing roll unit 19 that is located between the cutting member 6 and the overlapping-area-forming mechanism 7 and presses the adhesive tape 3 with the overlapping area 3E to the object; a pressing member 8 that is located downstream of the cutting member 6, comes into contact with the non-adhesive surface 3B of the adhesive tape 3, and presses the adhesive tape 3, which has been cut by the cutting member 6, to the object; and a tape cover 9 mounted on the main bracket 2 in such a manner that the tape cover 9 can rotate on the main bracket 2.

This adhesive tape cutter 1 is used to pull out and cut off a desired length of the adhesive tape 3 from the wound body of adhesive tape 4, which is formed by winding the long adhesive tape 3 of about 50 mm width in a roll. When various goods are packed in packaging boxes such as cardboard boxes, the adhesive tape cutter 1 is used to seal the tops of the cardboard boxes with the adhesive tape 3. The shape of the adhesive tape cutter 1 is designed so that a user can attach and cut off the adhesive tape 3 while holding the adhesive tape cutter 1 in his/her hand.

As shown in FIGS. 8 and 9, the wound body of adhesive tape 4 is formed by winding, in a roll, the adhesive tape 3 which has the adhesive surface 3A on one side, and the non-adhesive surface 3B on the other side.

Figure 20:
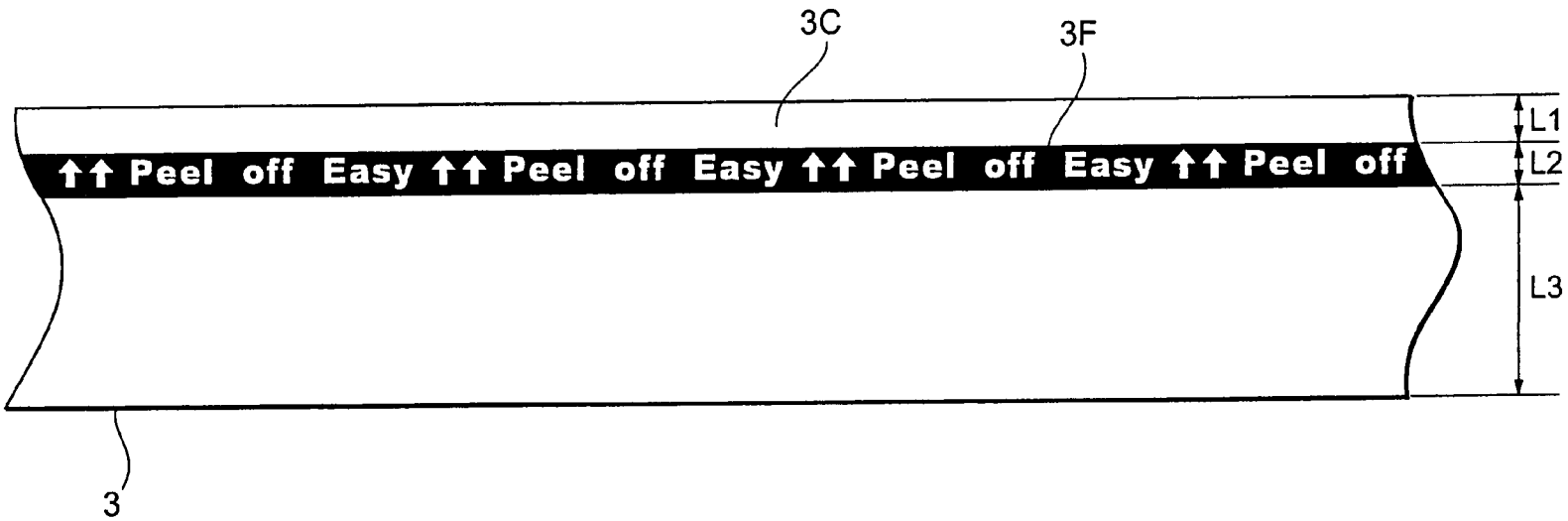
FIG. 20 is a fragmentary plan view of the adhesive tape used for the adhesive tape cutter according to the embodiment.

As shown in FIG. 20, the adhesive tape 3 has a continuous marked line 3F of width $L_2$ running in the lengthwise direction of the adhesive tape 3 at a position distance $L_1$ from one edge of the adhesive tape 3. An area extending from one edge of the adhesive tape 3 to the marked line 3F (an area defined by distance $L_1$) is margin 3C of the adhesive tape 3. The words "Peel off Easy" are indicated on this marked line 3F. Reference numeral $L_3$ in FIG. 20 indicates the distance from the marked line 3F to the other edge of the adhesive tape 3 opposite the above-mentioned margin 3C.

When the adhesive tape cutter 1 according to this embodiment, described later in detail, folds the margin 3C of this adhesive tape 3 under and forms an overlapping area 3E (see FIG. 10), the marked line 3F becomes adjacent to the overlapping area 3E.

The main bracket 2 comprises: a support plate 2A; a wall 2B formed at an angle of about 90 degrees with the support plate 2A and located at one end of the support plate 2A (on the left side in FIG. 2); and a side plate 2C formed on the other side of the wall 2B opposite the support plate 2A.

The support member 5 comprises: a hollow cylindrical tape holder 11 formed integrally with, and located at one end of, the support plate 2A of the main bracket 2 (on the right side in FIG. 2); and a flange 12 formed at one end of the tape holder 11. This flange 12 is formed in such a manner that it is capable of engaging the wound body of adhesive tape 4 mounted on the tape holder 11 so as to prevent the wound body of adhesive tape 4 from falling off, and is also capable of coming into contact with a protruding part 26A of the tape cover 9 described later in detail. The flange 12 serves to form a space to receive the wound body of adhesive tape 4 between the support member 5 and the inside surface 9A of the tape cover 9 opposite the wound body of adhesive tape 4. A hollow part 13 of the tape holder 11 is cylindrical in shape corresponding to the inside diameter of the tape holder 11, and a user can hold the adhesive tape cutter 1 by inserting his/her fingers into this hollow part 13.

The cutting member 6 is composed of a cutter blade whose ends are supported by and fixed to one end of the support plate 2A of the main bracket 2 and the side plate 2C.

The overlapping-area-forming mechanism 7 comprises: a fold-starting roll 15 placed near the support member 5 on the support plate 2A of the main bracket 2; a main folding member 16 placed downstream of the fold-starting roll 15 on the support plate 2A; and an attaching roll 17 that is rotatable and is located at a position opposite the main folding member 16 on the support plate 2A, and presses and attaches the margin 3C of the adhesive tape 3 folded under by the main folding member 16 to the adhesive surface 3A of the adhesive tape 3.

The fold-starting roll 15 is cylindrical in shape, having a comparatively large diameter, and is in an open-ended state with one end of the fold-starting roll 15 being attached in a rotatable manner to the support plate 2A of the main bracket 2. This fold-starting roll 15 is structured to support the adhesive surface 3A of the adhesive tape 3, except for a specified folding width along the margin 3C of the adhesive tape 3 (see FIG. 10), and to fold the folding width area of the margin 3C of the adhesive tape 3. A plurality of grooves 15A is formed circumferentially on the surface of the fold-starting roll 15. The existence of such grooves 15A makes it possible to reduce the contact area with the adhesive surface 3A of the adhesive tape 3. As a result, it is possible to reduce the power necessary to pull out the adhesive tape 3 from the wound body of adhesive tape 4, and thus unwind the adhesive tape 3 more smoothly.

A flange 15B is formed at one end of the fold-starting roll 15 that is not fixed to the support plate 2A of the main bracket 2. The distance between this flange 15B and a contact part 24 (see FIG. 3) of the main folding member 16 described later in detail that comes into contact with the margin 3C of the adhesive tape 3 where the overlapping area 3E (see FIGS. 8 and 10) is to be formed, is set to be shorter than the width of the adhesive tape 3. Therefore, the flange 15B plays the role of a controlling member for controlling the position of the adhesive tape 3.

The main folding member 16 comprises the following components listed in order from upstream to downstream: a fold-angle-maintaining member 21 that comes into contact with the non-adhesive surface 3B of the margin 3C of the adhesive tape 3 and maintains the fold angle of the margin 3C; a first folding guide member 22 that is connected to the fold-angle-maintaining member 21 and guides the adhesive tape 3 so that the fold angle of the margin 3C of the adhesive tape 3 becomes approximately 120 degrees, that is, the fold angle on the adhesive surface 3A side becomes an acute angle of approximately 60 degrees; and a second folding guide member 23 that is connected to the first folding guide member 22 and comes into contact with and folds the non-adhesive surface 3B of the margin 3C of the adhesive tape 3 under, to fold the adhesive tape 3 completely onto itself.

The fold-angle-maintaining member 21 is intended to fold under, at an acute angle, the area of the adhesive tape 3 folded by the fold-starting roll 15, and is formed in such a manner that it projects from the main bracket 2. Because of this projection, the fold-angle-maintaining member 21 constitutes the contact part 24 that comes into contact with the non-adhesive surface 3B of the adhesive tape 3 along the margin 3C.

The first folding guide member 22 is inclined so that the edge of its end not attached to the support plate 2A of the main bracket 2 is formed at an acute angle. The fold angle of the margin 3C of the adhesive tape 3 is determined according to this angle of inclination.

The second folding guide member 23 projects further than the first folding guide member 22 from the support plate 2A of the main bracket 2. The area of the second folding guide member 23 where the folded margin 3C of the adhesive tape 3 passes is structured to provide a narrow space between the second folding guide member 23 and the attaching roll 17 described below in detail. This narrow space serves to make the second folding guide member 23 come into contact with the non-adhesive surface 3B of the margin 3C of the adhesive tape 3 and to fold the margin 3C under, to fold the adhesive tape 3 completely onto itself.

The attaching roll 17 is cylindrical in shape and is in an open-ended state with one end attached in a rotatable manner to the support plate 2A of the main bracket 2. This attaching roll 17 is located opposite and near the second folding guide member 23, supports the non-adhesive surface 3B of the adhesive tape 3, presses the margin 3C of the adhesive tape 3 folded under by the main folding member 16 to the adhesive surface 3A, and causes the adhesive surfaces 3A in this folded area to be placed one over the other and be stuck to each other, thereby forming the overlapping area 3E. This attaching roll 17 is of a length short enough to cover and come into contact with the margin 3C of the adhesive tape 3, so that the adhesive tape 3 can be inserted between the main folding member 16 and the attaching roll 17 easily.

By having the attaching roll 17 and the non-adhesive surface 3B of the adhesive tape 3 pressing against it, it is possible to reduce the tension on the adhesive tape 3 and to fold the margin 3C of the adhesive tape 3 under smoothly and with certainty. As a result, it is possible to reduce the operating power (or pulling power) needed to unwind the adhesive tape 3 and hence, enhance operability as much as possible.

The pressing roll unit 19 comprises: a first pressing roll 31 located downstream of and close to the main folding member 16; and a second pressing roll 32 that is located downstream of the first pressing roll 31 and supports and presses the entire non-adhesive surface 3B of the adhesive tape 3.

The first pressing roll 31 is cylindrical in shape and is in an open-ended state with its one end attached in a rotatable manner to the support plate 2A of the main bracket 2. The first pressing roll 31 supports the adhesive surface 3A of the adhesive tape 3 and is of length short enough to cover and come into contact with the width of the overlapping area 3E formed on the adhesive tape 3. Moreover, a plurality of grooves 31A is formed circumferentially over the surface of the first pressing roll 31. Because of the short length and the existence of the grooves 31A, it is possible to reduce the contact area with the adhesive surface 3A of the adhesive tape 3. As a result, it is possible to further reduce the power necessary to pull out the adhesive tape 3 from the wound body of adhesive tape 4, and thus unwind the adhesive tape 3 more smoothly.

The second pressing roll 32 is located at one end of the support plate 2A on the main bracket 2, i.e., directly below the cutting member 6. One end of the second pressing roll 32 is supported by the support plate 2A, while the other end is supported by the side plate 2C, so that the second pressing roll 32 can rotate on the main bracket 2. This second pressing roll 32 is made of, for example, rubber. When coming into contact with the non-adhesive surface 3B of the adhesive tape 3 with the overlapping area 3E, the second pressing roll 32 serves to press the adhesive tape 3 to the object and to ensure the attachment of the adhesive tape 3 to the object.

The pressing member 8 is located on the outside surface of the main bracket 2; comes into contact with the non-adhesive surface 3B of the adhesive tape 3, on which the overlapping area 3E is formed on the margin 3C and which has passed the pressing roll unit 19; presses the adhesive tape 3 to the object; and ensures the attachment of the adhesive tape 3, which has been cut by the cutting member 6, to the object. This pressing member 8 is made of, for example, a flat rubber plate and is bent in a curved shape so that its top end closer to the cutting member 6 is positioned apart from the cutting member 6.

The top end of the pressing member 8 also serves as an adhesive-tape-positioning member for positioning the adhesive tape 3, which has been cut by the cutting member 6, near the cutting member 6. Accordingly, the adhesive tape 3 cut off by the cutting member 6 is positioned near the cutting member 6 and, therefore, it is possible to prevent the occurrence of trouble, for example, to prevent the adhesive tape 3 from becoming stuck to other objects and making the tape cutter 1 no longer operable.

One end of the tape cover 9 is attached via pins 25 to one end (closer to the cutting member 6) of the support place 2A of the main bracket 2 and to the side plate 2C so that the tape cover 9 can rotate; and the tape cover 9 forms a grippable part by covering part of the wound body of adhesive tape 4 supported by the support member 5 and coming into contact with the outside surface of the wound body of adhesive tape 4. On both sides of the adhesive tape 3 in its widthwise direction at the end of the tape cover 9 close to the support member 5, there are protruding parts 26A and 26B that protrude from the tape cover 9 toward the support member 5. These protruding parts 26A and 26B come into contact with the side faces of the wound body of adhesive tape 4 mounted on the tape holder 11, move the position of the wound body of adhesive tape 4 to the side plate 2A, and ensure the formation of the overlapping area 3E when a user grips the tape cover 9 and pulls out the adhesive tape 3 from the wound body of adhesive tape 4. The protruding parts 26A and 26B also serve to engage the wound body of adhesive tape 4 in order to prevent it from falling off from the support member 5.

Moreover, a convex part 9B that can come into contact with the outside surface of the wound body of adhesive tape 4 is formed on the inside surface 9A of the tape cover 9. When a user holds the tape cover 9 and pulls out the adhesive tape 3 from the wound body of adhesive tape 4, the existence of the convex part 9B prevents, with more certainty, the tape cover 9 from holding down the wound body of adhesive tape 4, thereby making it possible to unwind the adhesive tape 3 more easily.

Regarding this adhesive tape cutter 1, an area extending from the top end of the cutting member 6 (top end on the left side in FIG. 2) to the top end of the tape cover 9 close to the support member 5 (top end on the right side in FIG. 2) has a curved shape, thereby realizing a structure that enables easy operation for a user to hold the tape cutter 1 and attach the adhesive tape 3 to the object.

Detailed actions of the adhesive binding tape cutter 1 according to Embodiment 1 are described below:

The tape cover 9 is first made to rotate outward on the main bracket 2 in order to form a space between the support member 5 and the tape cover 9, and a roll core 4A of the wound body of adhesive tape 4 is then set on the support member 5 of the adhesive tape cutter 1 so that the non-adhesive surface 3B of the adhesive tape 3 drawn from the wound body of adhesive tape 4 faces the tape cover 9.

Subsequently, the adhesive tape 3 is set on the adhesive tape cutter 1 in the following manner: the adhesive surface 3A of the adhesive tape 3 is placed on the fold-starting roll 15; the adhesive tape 3 is inserted between the main folding member 16 and the attaching roll 17; and the adhesive surface 3A of the adhesive tape 3 faces the first pressing roll 31, while the non-adhesive surface 3B of the adhesive tape 3 faces the second pressing roll 32. The tape cover 9 is then moved to its original position so as to cover part of the outside surface of the wound body of adhesive tape 4.

A user inserts his/her fingers into the hollow part 13 of the adhesive tape cutter 1 in the above-described state, holds the adhesive tape cutter 1 by grabbing the tape cover 9, presses the adhesive tape 3, via the second pressing roll 32, to the object, and pulls the adhesive tape cutter 1 toward himself/herself, thereby causing the adhesive tape 3 to be pulled out from the wound body of adhesive tape 4 and to be attached to the object. At this moment, the flange 15B of the fold-starting roll 15 engages the edge of the adhesive tape 3 on the flange 15B side and thereby controls the position of the adhesive tape 3. This control causes the margin 3C of the adhesive tape 3 on the flange 15B side to come free from the end of the fold-starting roll 15 on the support plate 2A side. In other words, the fold-starting roll 15 supports the adhesive surface 3A of the adhesive tape 3 except for a specified folding width along the margin 3C of the adhesive tape 3, and then folds the folding width area.

Subsequently, after the adhesive tape 3 has passed the fold-starting roll 15, the non-adhesive surface 3B of the margin 3C comes into contact with the fold-angle-maintaining member 21 of the main folding member 16. While the fold angle of the margin 3C folded by the fold-starting roll 15 is maintained, the adhesive tape 3 reaches the first folding guide member 22. This first folding guide member 22 further folds the margin 3C of the adhesive tape 3 so as to cause the fold angle of the margin 3C of the adhesive tape 3 to become approximately 120 degrees. The adhesive tape 3 is then inserted between the second folding guide member 23 and the attaching roll 17, thereby folding the margin 3C of the adhesive tape 3 under, to fold the adhesive tape 3 completely onto itself. The adhesive surfaces 3A of this folded area of the adhesive tape 3 are stuck together to form the overlapping area 3E.

Then the adhesive tape 3 with the overlapping area 3E passes the first pressing roll 31, and then enters the space between the first pressing roll 31 and the second pressing roll 32, and the second pressing roll 32 finally presses and attaches the adhesive tape 3 to the object. The adhesive tape 3 will continue to be pulled out from the wound body of adhesive tape 4 and be attached to the object in the above-described state until it is cut by the cutting member 6.

When a user has finished attaching a desired length of the adhesive tape 3, the user can cut the adhesive tape 3 with the cutting member 6 easily by turning the adhesive tape cutter 1, which he/she holds (in his/her right hand), counterclockwise around the axis of the cutting member 6. At this moment, the pressing member 8 presses the adhesive tape 3, which has been cut off, to the object. Accordingly, after attaching the adhesive tape 3 to the object, the user can secure the affixation of the adhesive tape 3 to the object without taking the trouble to use his/her hand or anything else to press the adhesive tape 3 to the object. Moreover, the adhesive tape 3 does not bend inadvertently and it is thereby possible to attach the adhesive tape 3 to the object more smoothly.

In forming the overlapping area 3E along the margin 3C of the adhesive tape 3, the convex part 9B formed on the tape cover 9 comes into contact with the outside surface of the wound body of adhesive tape 4, thereby forming a space between the inside surface 9A of the tape cover 9 and the outside surface of the wound body of adhesive tape 4. Accordingly, it is possible to prevent the tape cover 9 from holding down the wound body of adhesive tape 4 when pulling out the adhesive tape 3 from the wound body of adhesive tape 4. Therefore, it is possible to unwind the adhesive tape 3 more easily. Moreover, since the protruding parts 26A and 26B control the position of the wound body of adhesive tape 4 mounted on the tape holder 11, it is possible to ensure the formation of the overlapping area 3E along the margin 3C of the adhesive tape 3.

The above-described actions cause the adhesive surface 3A of the adhesive tape 3 to come into contact with the surface of the fold-starting roll 15. However, a plurality of grooves 15A formed over the surface of the fold-starting roll 15 reduces the contact area with the adhesive surface 3A, and it is thereby possible to reduce the power necessary to pull out the adhesive tape 3 from the wound body of adhesive tape 4. Also, there is no member (such as a roller) pressing the adhesive tape 3 hard against the fold-starting roll 15. Therefore, the adhesive surface 3A of the adhesive tape 3 is not firmly attached to the surface of the fold-starting roll 15, making it possible to unwind the adhesive tape 3 smoothly.

The adhesive surface 3A of the adhesive tape 3 also comes into contact with the surface of the first pressing roll 31. However, since the first pressing roll 31 is short and has a plurality of grooves 31A on its surface, it is possible to reduce the contact area with the adhesive surface 3A of the adhesive tape 3. As a result, it is possible to further reduce the power necessary to pull out the adhesive tape 3 from the wound body of adhesive tape 4, and thus unwind the adhesive tape 3 more smoothly.

As the adhesive tape 3 on which the overlapping area 3E is formed is attached to the object by the above-described steps, this overlapping area 3E serves as a tab that makes it easier to peel off the adhesive tape 3, and it is thereby possible to easily peel off the adhesive tape 3 from the object. Since there is the marked line 3F near this tab (i.e., the overlapping area 3E), it is possible to locate the tab easily and to conduct the binding removal process more simply.

It is also possible to automatically form the overlapping area 3E when attaching the adhesive tape 3 to the object.

EMBODIMENT 2

An adhesive tape cutter according to Embodiment 2 of this invention is described below with reference to the relevant drawings.

Figure 11:
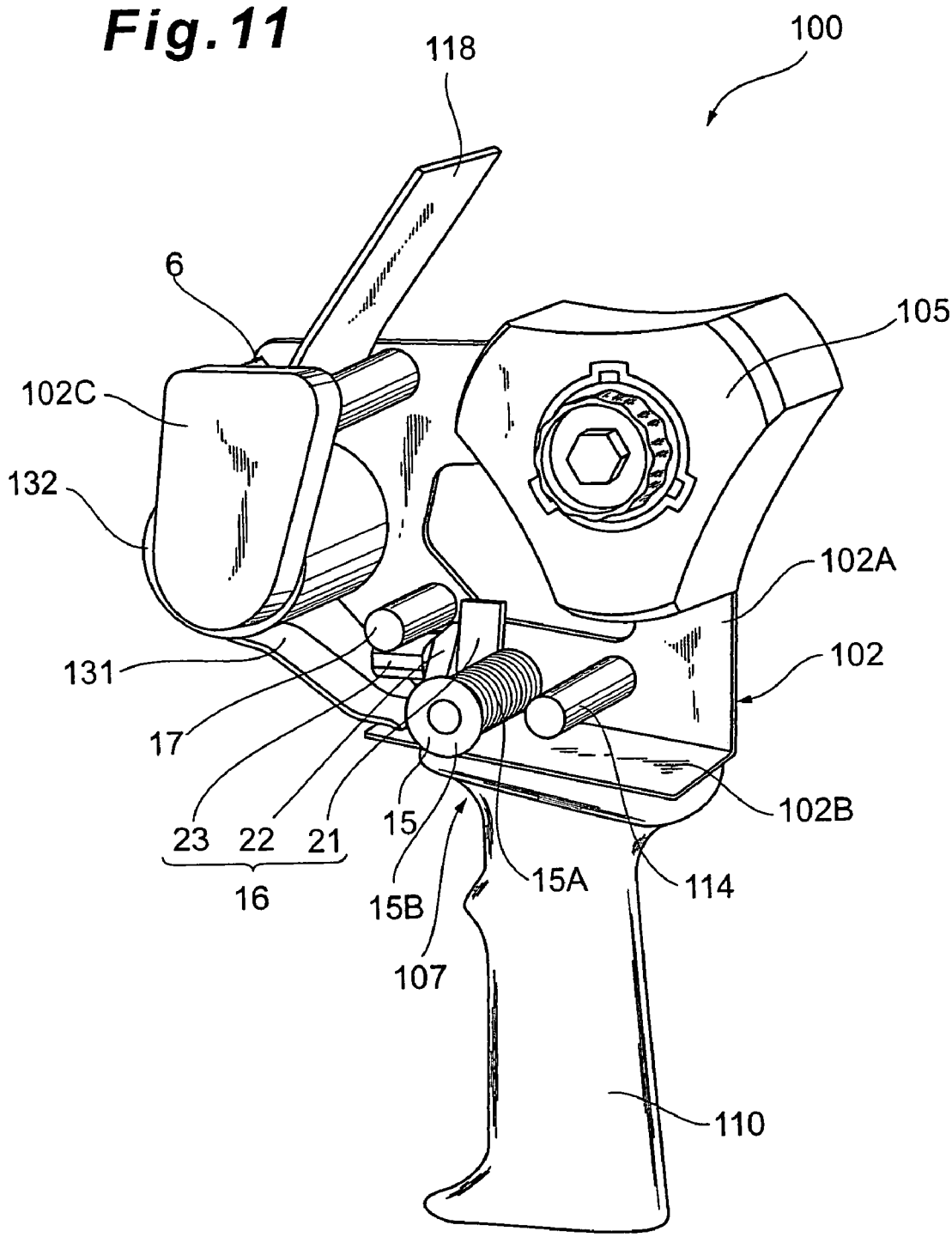
FIG. 11 is a perspective view of an adhesive tape cutter according to Embodiment 2 of this invention.
Figure 12:
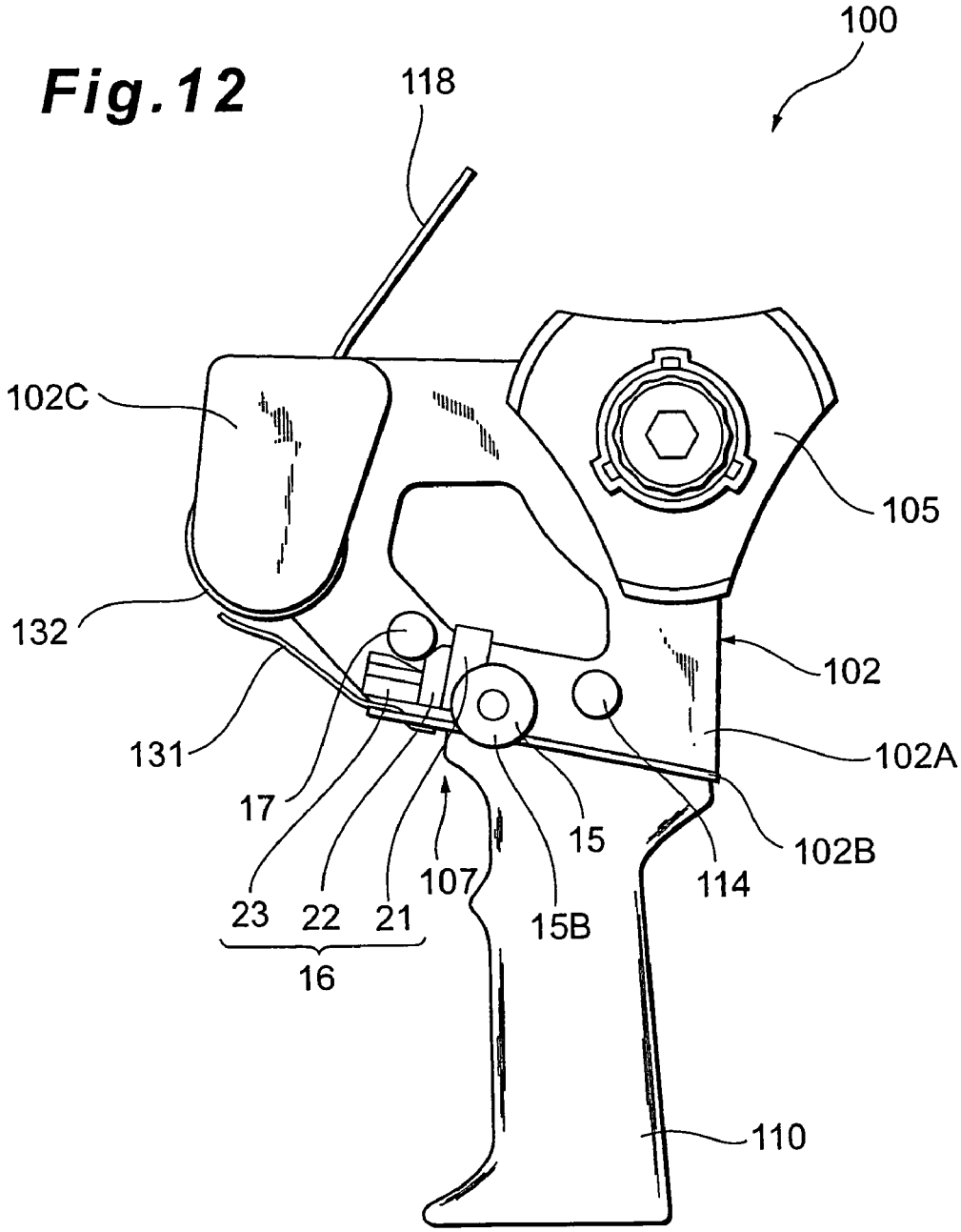
FIG. 12 is a front view of the adhesive tape cutter in FIG. 11.
Figure 13:
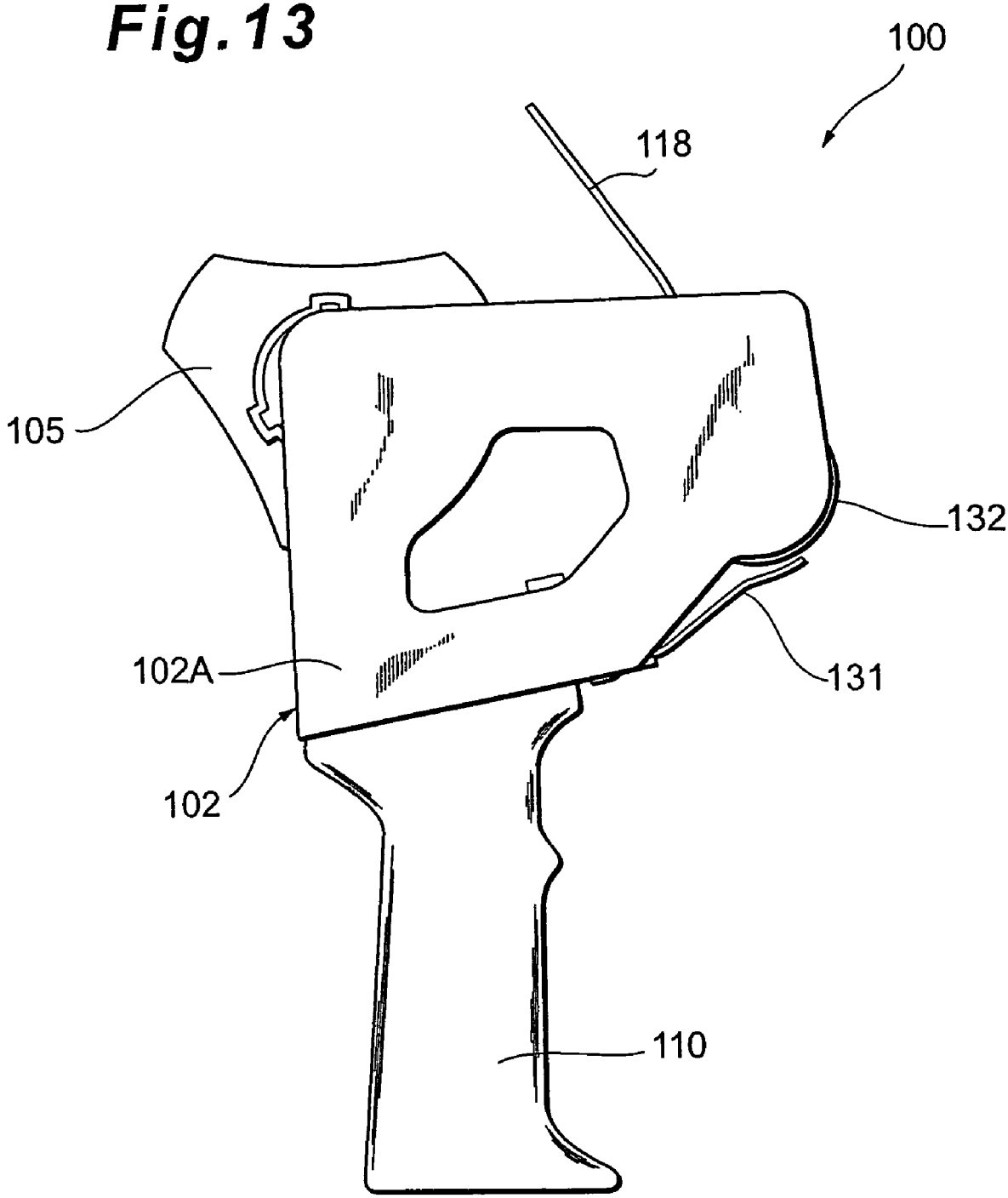
FIG. 13 is a rear view of the adhesive tape cutter in FIG. 12.
Figure 14:
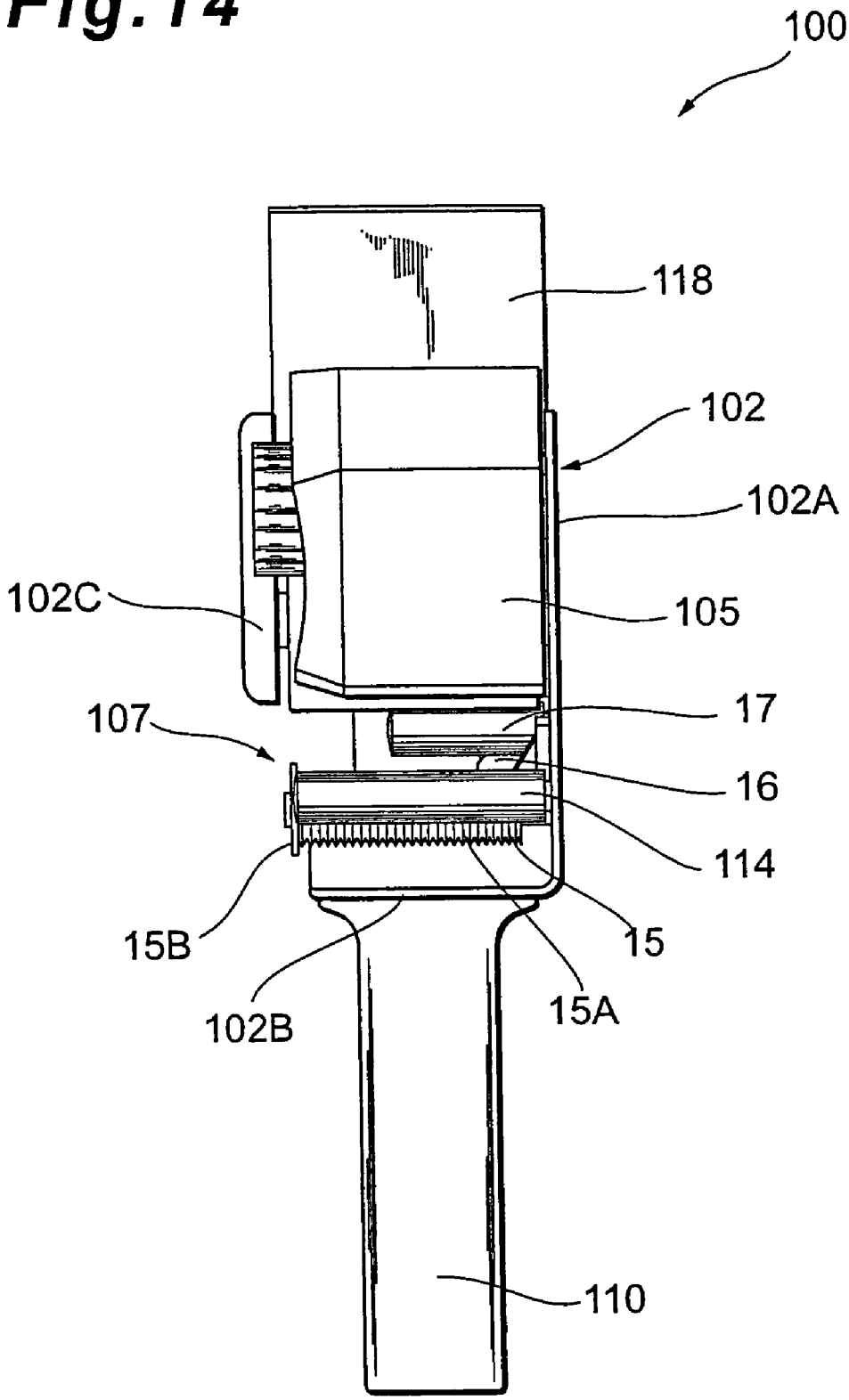
FIG. 14 is a right side view of the adhesive tape cutter in FIG. 12.
Figure 15:
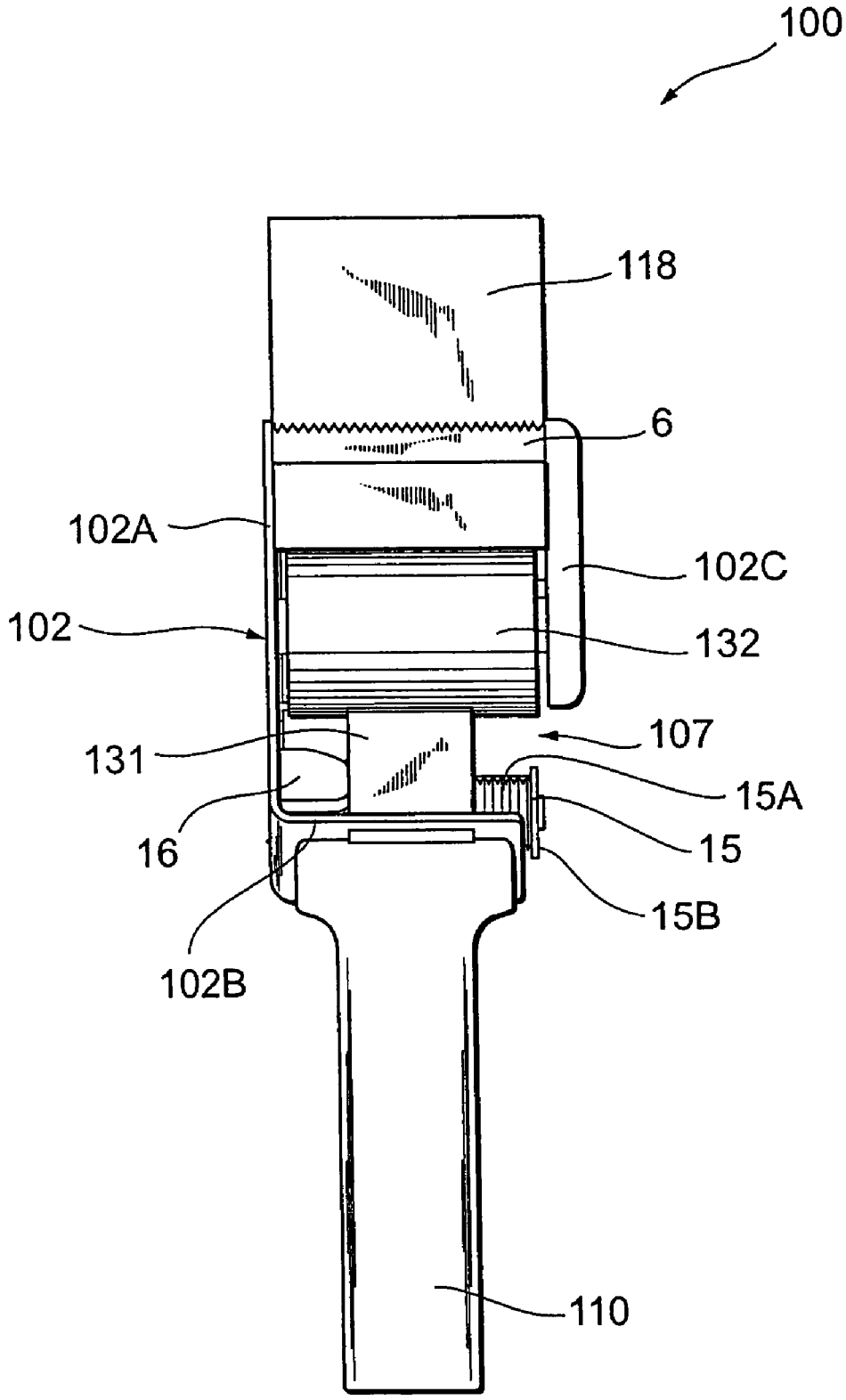
FIG. 15 is a left side view of the adhesive tape cutter in FIG. 12.
Figure 16:
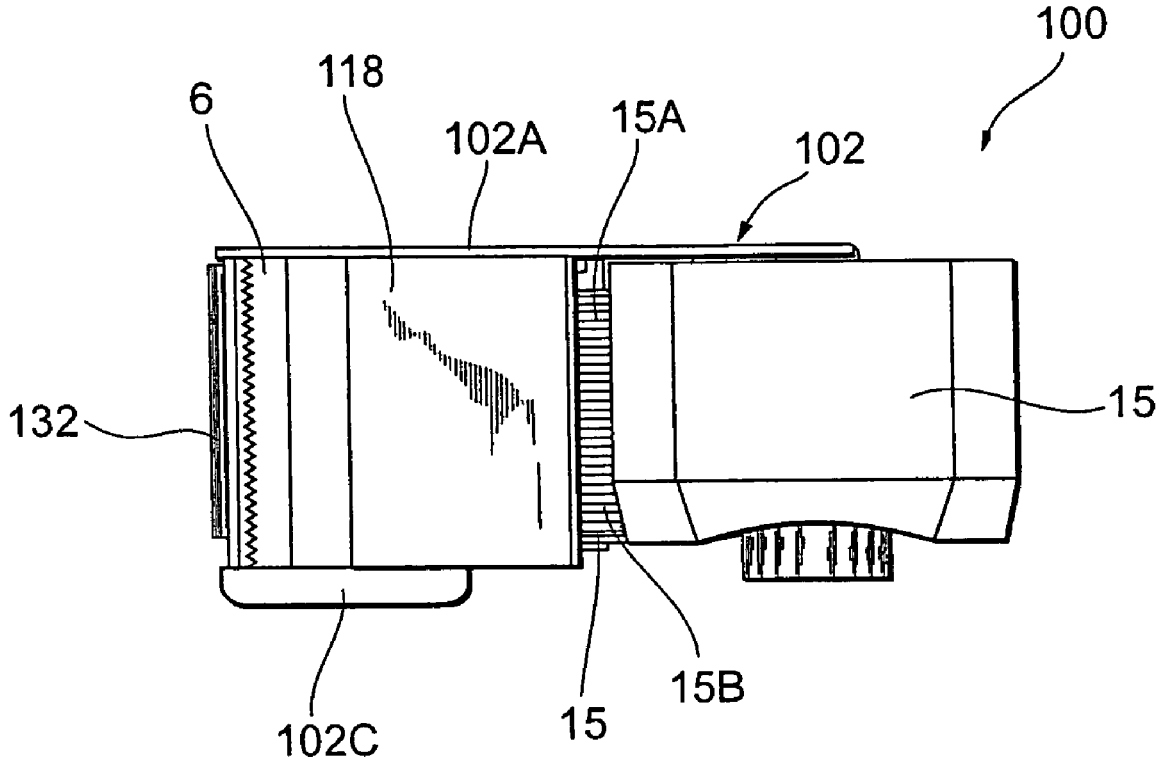
FIG. 16 is a top view of the adhesive tape cutter in FIG. 12.
Figure 17:
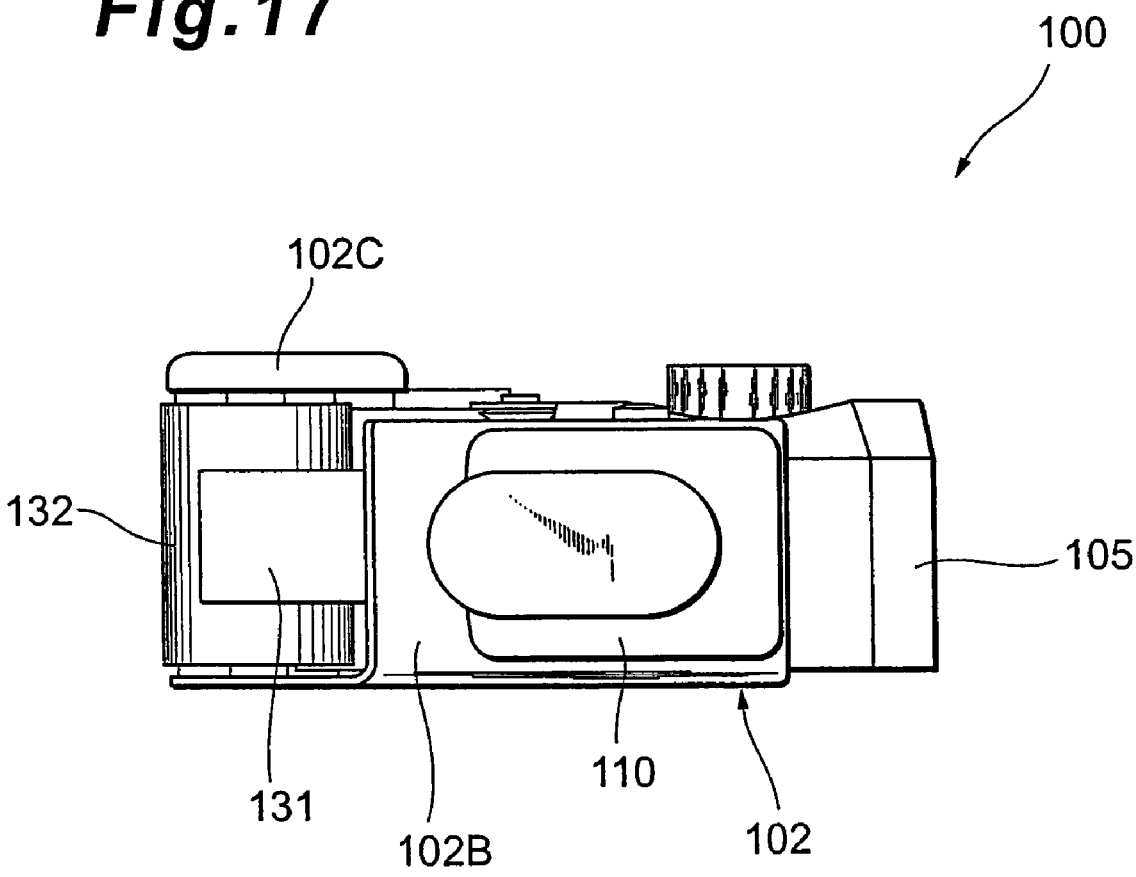
FIG. 17 is a bottom view of the adhesive tape cutter in FIG. 12.
Figure 18:
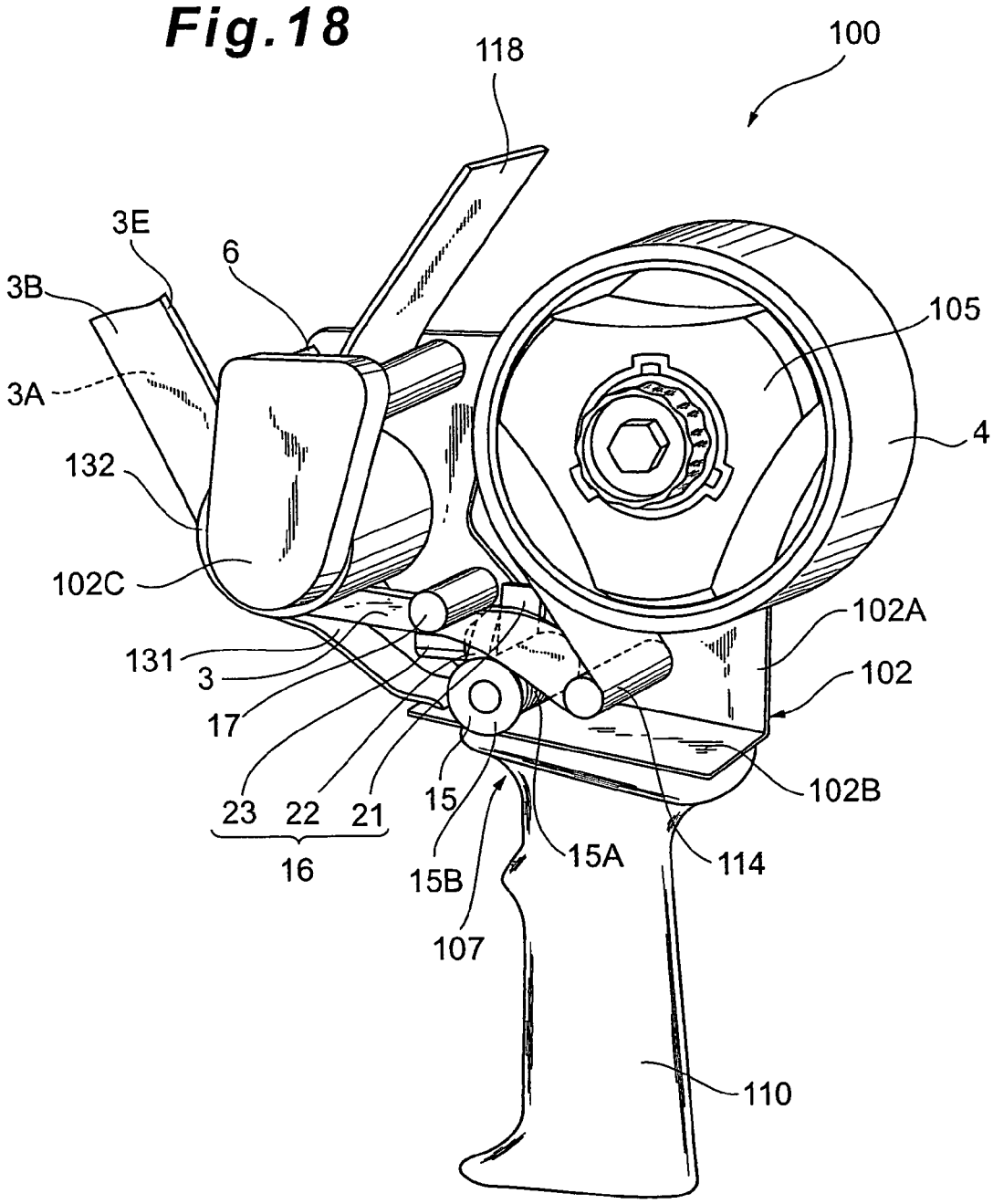
FIG. 18 shows the state in which the wound body of adhesive tape is mounted on the adhesive tape cutter in FIG. 12.
Figure 19:
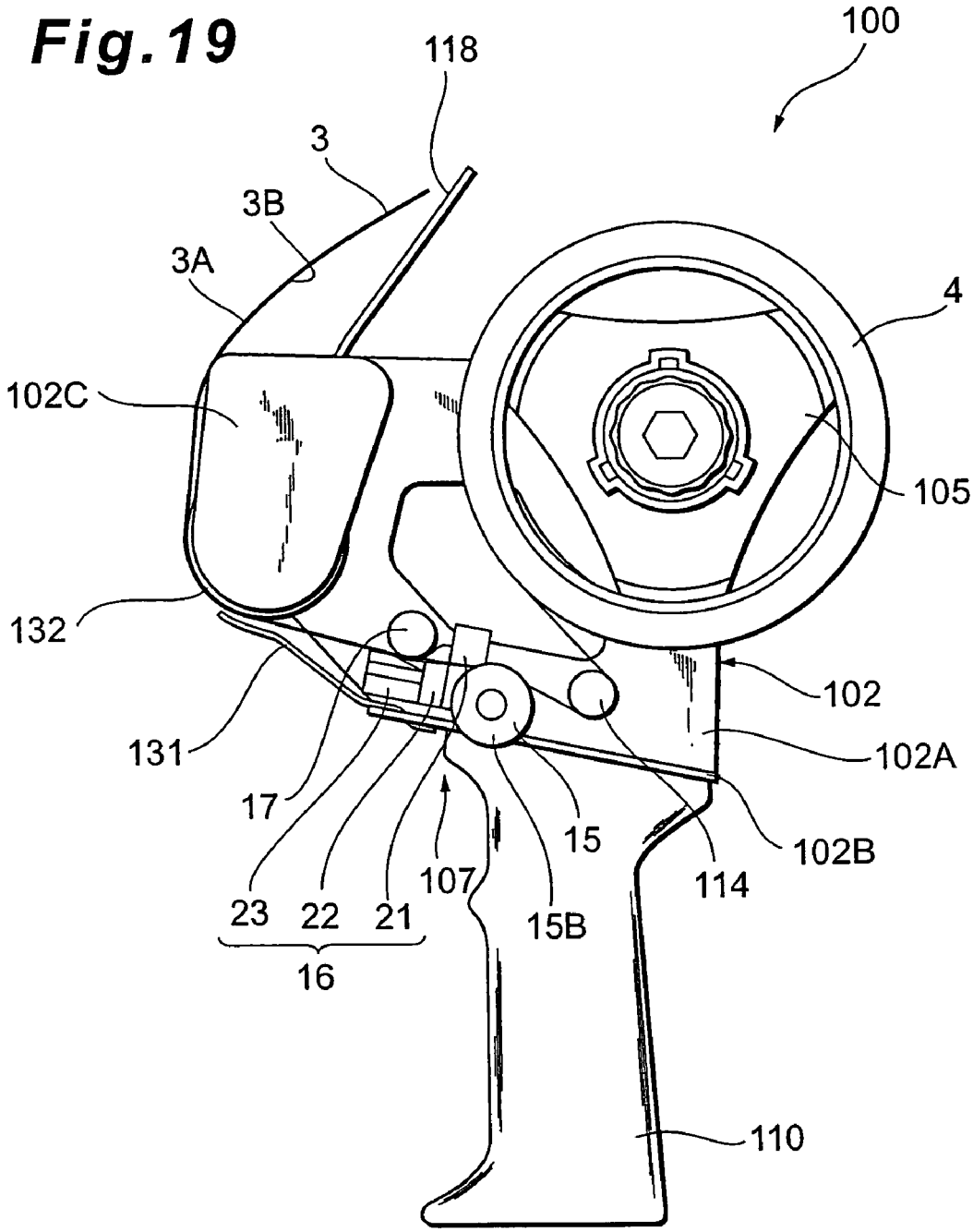
FIG. 19 shows the state in which the wound body of adhesive tape is mounted on the adhesive tape cutter in FIG. 13.

FIG. 11 is a perspective view of the adhesive tape cutter according to Embodiment 2 of this invention. FIG. 12 is a front view of the adhesive tape cutter in FIG. 11. FIG. 13 is a rear view of the adhesive tape cutter in FIG. 12. FIG. 14 is a right side view of the adhesive tape cutter in FIG. 12. FIG. 15 is a left side view of the adhesive tape cutter in FIG. 12. FIG. 16 is a top view of the adhesive tape cutter in FIG. 12. FIG. 17 is a bottom view of the adhesive tape cutter in FIG. 12. FIG. 18 shows the state in which the wound body of adhesive tape is mounted on the adhesive tape cutter in FIG. 12. FIG. 19 shows the state in which the wound body of adhesive tape is mounted on the adhesive tape cutter in FIG. 13.

Elements of Embodiment 2 that are similar to those of Embodiment 1 are given the same reference numerals as in Embodiment 1, and any detailed description about such elements is omitted.

As shown in FIGS. 11 to 19, an adhesive tape cutter 100 according to Embodiment 2 of this invention comprises: a main bracket 102; a support member 105 that is located at one end of the main bracket 102 and supports a wound body of adhesive tape 4 that is made by winding an adhesive tape 3, one side of which is an adhesive surface 3A, in a roll in such a manner that the wound body of adhesive tape 4 can rotate; a cutting member 6 that is located at the other end of the main bracket 102 and cuts the adhesive tape 3 drawn from the wound body of adhesive tape 4 supported by the support member 105; an overlapping-area-forming mechanism 107 that is located between the support member 105 and the cutting member 106 of the main bracket 102 and forms an overlapping area 3E of the adhesive tape 3, along at least one margin in its lengthwise direction, that is made by folding the margin 3C of the adhesive tape 3 in a specified width under toward the adhesive surface 3A side; a guiding piece 131 that is located downstream of the overlapping-area-forming mechanism 107 and guides the adhesive tape 3 with the overlapping area 3E downstream; a pressing roll 132 that is located at a position opposite the guiding piece 131 in the main bracket 102 and supports and presses the entire non-adhesive surface 3B of the adhesive tape 3 with the overlapping area 3E; a pressing member 118 that is located downstream of the cutting member 6, comes into contact with the non-adhesive surface 3B of the adhesive tape 3, presses the adhesive tape 3, which has been cut by the cutting member 6, to the object, and positions the cut-off adhesive tape 3 near the cutting member 6; and a holding part 110 fixed at a lower part of the main bracket 102 where the overlapping-area-forming mechanism 107 is located.

In the same manner as in Embodiment 1, this adhesive tape cutter 100 is also used to pull out and cut off a desired length of the adhesive tape 3 from the wound body of adhesive tape 4 which is formed by winding the long adhesive tape 3 of about 50 mm width in a roll. When various goods are packed in packaging boxes such as cardboard boxes, the adhesive tape cutter 100 is used to seal the tops of the cardboard boxes with the adhesive tape 3. The shape of the adhesive tape cutter 100 is designed so that a user can attach and cut off the adhesive tape 3 while holding the adhesive tape cutter 100 in his/her hand.

The main bracket 102 comprises: a support plate 102A; a bottom 102B located at the end of the support plate 2A closer to the holding part 110 (i.e., a lower part in FIG. 11) and formed at an angle of about 90 degrees with the support plate 102A; and a side plate 102C placed on the side of the support plate 102A, where the cutting member 6 is located (on the left side in FIG. 11), and opposite the support plate 102A.

The support member 105 is rotatable and is placed at one end of the support plate 2A of the main bracket 2 (on the right side in FIG. 11). This support member 105 is structured in such a manner that three points of the support member 105 come in contact with the roll core 4A of the wound body of adhesive tape 4 in order to retain the wound body of adhesive tape 4.

The overlapping-area-forming mechanism 107 comprises: a supporting roll 114 located near the support member 105 on the support plate 102A of the main bracket 102; a fold-starting roll 15 placed downstream of the supporting roll 114 on the support plate 102A; a main folding member 16 placed downstream of the fold-starting roll 15 on the support plate 2A; and an attaching roll 17 that is rotatable and is located opposite the main folding member 16 on the support plate 102A, and presses and attaches the margin 3C of the adhesive tape 3 folded under by the main folding member 16 to the adhesive surface 3A of the adhesive tape 3.

The supporting roll 114 is cylindrical in shape and is in an open-ended state with one end attached in a rotatable manner to the support plate 102A of the main bracket 102. This supporting roll 114 serves to support the non-adhesive surface 3B of the adhesive tape 3 and to smoothly guide the adhesive tape 3 drawn from the wound body of adhesive tape 4 toward the fold-starting roll 15.

The guiding piece 131 is in the shape of an approximately flat plate and extends from the bottom 102B of the main bracket 102 toward the pressing roll 132.

The pressing roll 132 is located at one end of the support plate 102A on the main bracket 102, i.e., directly below the cutting member 6. One end of the pressing roll 132 is supported by the support plate 102A, while the other end is supported by the side plate 102C, so that the pressing roll 32 can rotate on the main bracket 102. This pressing roll 132 is composed of, for example, a rubber roll. When coming into contact with the non-adhesive surface 3B of the adhesive tape 3, the pressing roll 132 presses the adhesive tape 3, on which the overlapping area 3E is formed, to the object and ensures the attachment of the adhesive tape 3 to the object.

The pressing member 118 is formed in an approximately plate shape that is placed between the support plate 102A and the side plate 102 C of the main bracket 102 and is inclined toward the support member 105. This pressing member 118 serves to ensure the affixation, to the object, of the adhesive tape 3 which has been cut by the cutting member 6 and attached to the object, and to position the cut-off adhesive tape 3 near the cutting member 6. Since this pressing member 118 can cause the adhesive tape 3 cut by the cutting member 6 to be positioned near the cutting member 6, it is possible to prevent the occurrence of trouble, for example, to prevent the adhesive tape 3 from becoming stuck to other objects and making the tape cutter 1 no longer operable.

The holding part 100 is of a size that can be held by the user and is placed at the bottom 102B of the main bracket 102.

Detailed actions of the adhesive tape cutter 100 according to Embodiment 2 are described below in detail.

The roll core 4A of the wound body of adhesive tape 4A is first set on the support member 105 of the adhesive tape cutter 100 so that the non-adhesive surface 3B of the adhesive tape 3 drawn from the wound body of adhesive tape 4 faces the bottom 102B.

Subsequently, the adhesive tape 3 is placed on the supporting roll 114 so that the non-adhesive surface 3B of the adhesive tape 3 faces the supporting roll 114. The adhesive surface 3A of the adhesive tape 3 is then placed on the fold-starting roll 15. Next, the adhesive tape 3 is inserted into a space between the main folding member 16 and the attaching roll 17, and then into a space between the guiding piece 131 and the pressing roll 132.

A user holds the adhesive tape cutter 1 in the above-described state, presses the adhesive tape 3, via the pressing roll 132, to the object, and pulls the adhesive tape cutter 100 toward himself/herself, thereby causing the adhesive tape 3 to be pulled out from the wound body of adhesive tape 4 and to be attached to the object. At this moment, the margin 3C of the adhesive tape 3 is folded under in the same manner as in Embodiment 1, thereby forming the overlapping area 3E there.

In the case of the adhesive tape cutter 100 according to Embodiment 2, it is possible, in the same manner as in Embodiment 1, to further reduce the power necessary to pull out the adhesive tape 3 from the wound body of adhesive tape 4 and thus unwind the adhesive tape 3 more smoothly.

The user can cut the adhesive tape 3, which is attached to the object, with the cutting member 6 easily by turning the adhesive tape cutter 1, which he/she holds (in his/her right hand), counterclockwise around the axis of the cutting member 6. At this moment, the pressing member 8 presses the adhesive tape 3, which has been cut off, to the object. Accordingly, after attaching the adhesive tape 3 to the object, the user can secure the affixation of the adhesive tape 3 to the object without taking the trouble to use his/her hand or anything to press the adhesive tape 3 to the object. Moreover, the adhesive tape 3 does not bend inadvertently and it is thereby possible to attach the adhesive tape 3 to the object more smoothly.

As the adhesive tape 3 on which the overlapping area 3E is formed is attached to the object by the above-described steps, this overlapping area 3E serves as a tab that makes it easier to peel off the adhesive tape 3, and it is thereby possible to easily peel off the adhesive tape 3 from the object. Since there is the marked line 3F near this tab (i.e., the overlapping area 3E), it is possible to locate the tab easily and to conduct the binding removal process more simply.

It is also possible to automatically form the overlapping area 3E when attaching the adhesive tape 3 to the object.

When the adhesive tape cutter of this invention is used to form the overlapping area on the adhesive tape that is pulled out from the wound body of adhesive tape, which is rotatable and supported by the tape support member, it is possible to pull out the adhesive tape from the wound body of adhesive tape with little power, without making the adhesive surface of the adhesive tape stuck fast to the surfaces of the components that constitute the overlapping-area-forming mechanism. As a result, it is possible to unwind the adhesive tape smoothly and to enhance the operability when binding an object with the adhesive tape. Moreover, since the adhesive tape cutter comprises the pressing member that comes into contact with the non-adhesive surface of the adhesive tape and presses the adhesive tape to the object, the adhesive tape does not bend inadvertently and it is thereby possible to attach the adhesive tape to the object more smoothly.

I claim:

1. An adhesive tape cutter for attaching, to an object, adhesive tape drawn from a wound body of adhesive tape made by winding the tape, one side of which is an adhesive surface, in a roll, the adhesive tape cutter comprising:

a support member located at one end of a main bracket to support the wound body of adhesive tape in such a manner that the wound body of adhesive tape can rotate;

a cutting member located at the other end of the main bracket to cut the adhesive tape drawn from the wound body of adhesive tape supported by the support member;

an overlapping-area-forming mechanism located between the support member and the cutting member to form an overlapping area of the adhesive tape, along at least one margin in its lengthwise direction, said overlapping area made by folding under a margin of a specified width of the adhesive tape toward the adhesive surface side; and a pressing member located downstream of the cutting member to press a non-adhesive surface of the adhesive tape that is cut by the cutting member and then attached to the object;

wherein the overlapping-area-forming mechanism comprises:

a fold-starting member that is located near an adhesive tape unwinding position of the wound body of adhesive tape, supports the non-adhesive surface of the adhesive tape, supports the adhesive surface of the adhesive tape except for a specified folding width along the margin of the adhesive tape, and folds the folding width area;

a main folding member that is located downstream of the fold-starting member and folds under, at an acute angle, the area of the adhesive tape folded by the fold-starting member; and an attaching member that is located downstream of the main folding member, supports the non-adhesive surface of the adhesive tape, and presses and attaches the area folded under by the main folding member to the adhesive surface of the adhesive tape.

2. The adhesive tape cutter according to claim 1, further comprising a pressing roll located between the cutting member and the overlapping-area-forming mechanism, that presses the adhesive tape with the overlapping area to the object.

3. The adhesive tape cutter according to claim 1 or 2, wherein the pressing member has an adhesive-tape-positioning member for positioning the adhesive tape near the cutting member after the adhesive tape is cut by the cutting member.

4. The adhesive tape cutter according to claim 1, further comprising a tape cover that is attached to and is rotatable on the main bracket, covers at least part of the wound body of adhesive tape supported by the support member, and comes into contact with the outside surface of the wound body of adhesive tape, thereby forming a grippable part.

5. The adhesive tape cutter according to claim 4, wherein a protruding part that protrudes from the tape cover toward the support member and can come into contact with the inside surface of the wound body of adhesive tape is formed at at least one side of the wound body of adhesive tape in its widthwise direction opposite the side where the overlapping area is formed.

6. The adhesive tape cutter according to claim 4, wherein the tape cover has a convex part located on the inside surface of the tape cover opposite the wound body of adhesive tape, that can come into contact with the wound body of adhesive tape.

7. The adhesive tape cutter according to claim 1, further comprising a supporting roll located between the overlapping-area-forming mechanism and the pressing roll, that supports and guides the adhesive tape to the pressing roll.

8. The adhesive tape cutter according to claim 7, wherein the surface of the supporting roll has protrusions and indentations.

9. The adhesive tape cutter according to claim 1, wherein an area extending from the cutting member to the top end of the tape cover along its outside surface closer to the support member has a curved shape.

10. The adhesive tape cutter according to claim 1, further comprising a holding part fixed at a lower part of the main bracket where the overlapping-area-forming mechanism is located.

11. The adhesive tape cutter according to claim 10, further comprising a guiding piece located near the pressing roll and opposite the adhesive surface of the adhesive tape, that guides the adhesive tape with the overlapping area.

12. The adhesive tape cutter according to claim 10, wherein the pressing member is a pressing plate that is located downstream of the attaching member and opposite the guiding piece, slopes toward the extending direction of the holding part, and supports and presses the entire non-adhesive surface of the adhesive tape with the overlapping area.

13. The adhesive tape cutter according to claim 1, further comprising another support member that is located upstream of the fold-starting member and supports the non-adhesive surface of the adhesive tape.

14. The adhesive tape cutter according to claim 1, wherein the surface of the fold-starting member has protrusions and indentations.

15. The adhesive tape cutter according to claim 1, wherein the fold-starting member and the attaching member are roller members located in a rotatable manner so that they guide the adhesive tape from upstream to downstream.

16. The adhesive tape cutter according to claim 1, wherein a controlling member for controlling the position of the adhesive tape is placed at the end of the fold-starting member on the side opposite the margin where the overlapping area of the adhesive tape is formed.

17. The adhesive tape cutter according to claim 16, wherein the distance between the controlling member of the fold-starting member and a contact part of the main folding member that comes into contact with the margin side of the overlapping area of the adhesive tape is shorter than the width of the adhesive tape that forms the wound body of adhesive tape.

18. The adhesive tape cutter according to claim 1, wherein the main folding member has a pressing member capable of pressing only part of the adhesive tape, including the area folded by the fold-starting member.

19. The adhesive tape cutter according to claim 1, wherein the main folding member comprises:

a first folding guide member that comes into contact with the non-adhesive surface of the adhesive tape folded by the fold-starting member and guides the adhesive tape so that the fold angle of the adhesive tape becomes more acute; and a second folding guide member for guiding the adhesive tape and folding the adhesive tape completely on to itself.

* * * * *